US007295173B2

(12) United States Patent
Itoh et al.

(10) Patent No.: US 7,295,173 B2
(45) Date of Patent: Nov. 13, 2007

(54) IMAGE DISPLAY METHOD

(75) Inventors: Goh Itoh, Yokohama (JP); Masahiro Baba, Yokohama (JP); Kazuki Taira, Tokyo (JP); Haruhiko Okumura, Fujisawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 318 days.

(21) Appl. No.: 11/059,385

(22) Filed: Feb. 17, 2005

(65) Prior Publication Data

US 2005/0156843 A1 Jul. 21, 2005

Related U.S. Application Data

(63) Continuation of application No. 10/190,661, filed on Jul. 9, 2002, now Pat. No. 6,970,148.

(30) Foreign Application Priority Data

Jul. 10, 2001 (JP) ..... 2001-209689

(51) Int. Cl.
*G09G 3/28* (2006.01)

(52) U.S. Cl. ..... 345/63; 345/3.2; 345/426; 345/475; 345/589; 348/477; 348/459; 348/490; 382/236

(58) Field of Classification Search ..... 345/3.2; 348/447

See application file for complete search history.

(56) References Cited

U.S. PATENT DOCUMENTS

| | | | | |
|---|---|---|---|---|
| 6,097,368 | A | 8/2000 | Zhu et al. | |
| 6,310,588 | B1 | 10/2001 | Kawahara et al. | |
| 6,323,880 | B1 | 11/2001 | Yamada | |
| 6,335,735 | B1 | 1/2002 | Denda et al. | |
| 6,340,961 | B1 | 1/2002 | Tanaka et al. | |
| 6,518,997 | B1 | 2/2003 | Naka et al. | |
| 6,597,331 | B1 | 7/2003 | Kim | |
| 6,831,948 | B1 * | 12/2004 | Van Dijk et al. | 375/240.12 |
| 6,970,148 | B2 * | 11/2005 | Itoh et al. | 345/63 |

FOREIGN PATENT DOCUMENTS

| | | |
|---|---|---|
| JP | 5-273523 | 10/1993 |
| JP | 10-326080 | 12/1998 |
| JP | 11-109921 | 4/1999 |
| JP | 11-259020 | 9/1999 |
| JP | 2000-10076 | 1/2000 |
| JP | 2000-338464 | 12/2000 |
| JP | 2001-281627 | 10/2001 |
| KR | 1998-024954 | 7/1998 |
| WO | WO 00/67248 | 11/2000 |

* cited by examiner

*Primary Examiner*—Kee M. Tung
*Assistant Examiner*—Antonio A Caschera
(74) *Attorney, Agent, or Firm*—Oblon, Spivak, McClelland, Maier & Neustadt, P.C.

(57) ABSTRACT

An image display method including dividing an original image for one frame period into a plurality of subfield images, arranging the subfield images in a direction of a time axis in an order of brightness of the subfield images, and displaying the arranged subfield images in the order of the brightness.

6 Claims, 20 Drawing Sheets

FIG. 2B
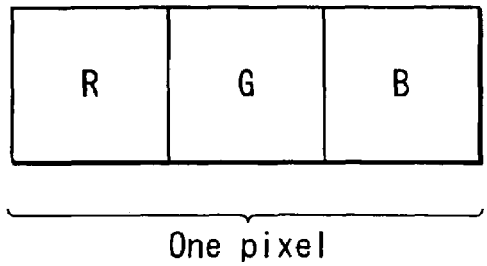
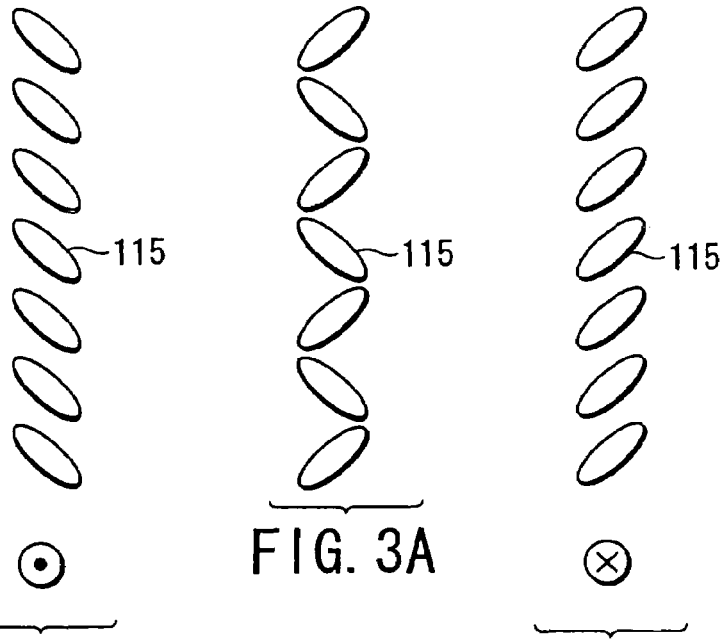
FIG. 3A
FIG. 3C
FIG. 3B
FIG. 4
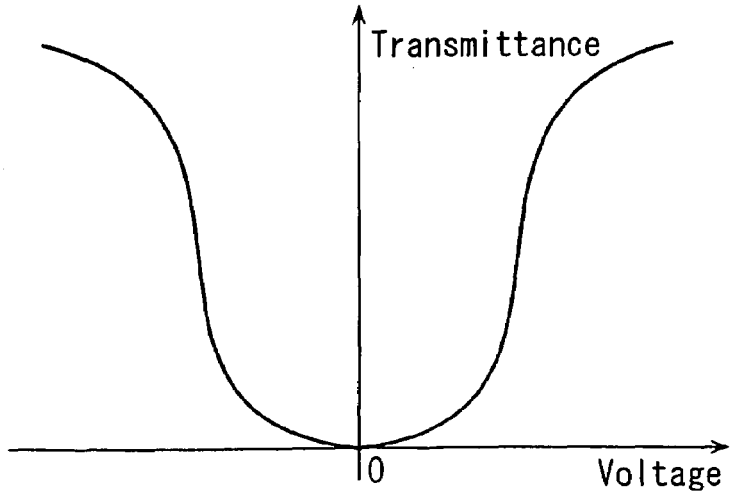

| | | |
|---|---|---|
| 60 | 44 | 16 |
| 52 | 28 | 12 |
| 40 | 8 | 4 |

| (b-1) | | | (b-2) | | | (b-3) | | |
|---|---|---|---|---|---|---|---|---|
| 60 | 44 | 16 | 60 | 44 | 16 | 60 | 44 | 16 |
| 52 | 28 | 12 | 52 | 28 | 12 | 52 | 28 | 12 |
| 40 | 8 | 4 | 40 | 8 | 4 | 40 | 8 | 4 |

| (c-1) | | | (c-2) | | | (c-3) | | |
|---|---|---|---|---|---|---|---|---|
| 60 | 44 | 16 | 0 | 0 | 0 | 30 | 22 | 8 |
| 52 | 28 | 12 | 0 | 0 | 0 | 26 | 14 | 6 |
| 40 | 8 | 4 | 0 | 0 | 0 | 20 | 4 | 2 |

| (d-1) | | | (d-2) | | | (d-3) | | |
|---|---|---|---|---|---|---|---|---|
| 90 | 66 | 24 | 30 | 22 | 8 | 60 | 44 | 16 |
| 78 | 42 | 18 | 26 | 14 | 6 | 52 | 28 | 12 |
| 60 | 12 | 6 | 20 | 4 | 2 | 40 | 8 | 4 |

| | | |
|---|---|---|
| 60 | 44 | 16 |
| 52 | 28 | 12 |
| 40 | 8 | 4 |

FIG. 7A (b-1)

| | | |
|---|---|---|
| 60 | 44 | 16 |
| 52 | 28 | 12 |
| 40 | 8 | 4 |

(b-2)

| | | |
|---|---|---|
| 60 | 44 | 16 |
| 52 | 28 | 12 |
| 40 | 8 | 4 |

(b-3)

| | | |
|---|---|---|
| 60 | 44 | 16 |
| 52 | 28 | 12 |
| 40 | 8 | 4 |

(b-4)

| | | |
|---|---|---|
| 60 | 44 | 16 |
| 52 | 28 | 12 |
| 40 | 8 | 4 |

(b-5)

| | | |
|---|---|---|
| 60 | 44 | 16 |
| 52 | 28 | 12 |
| 40 | 8 | 4 |

FIG. 7B (c-1)

| | | |
|---|---|---|
| 99 | 74 | 27 |
| 88 | 47 | 20 |
| 67 | 14 | 7 |

(c-2)

| | | |
|---|---|---|
| 66 | 49 | 18 |
| 58 | 31 | 13 |
| 44 | 9 | 5 |

(c-3)

| | | |
|---|---|---|
| 44 | 32 | 12 |
| 38 | 20 | 8 |
| 29 | 6 | 3 |

(c-4)

| | | |
|---|---|---|
| 31 | 21 | 7 |
| 24 | 14 | 7 |
| 20 | 3 | 1 |

(c-5)

| | | |
|---|---|---|
| 60 | 44 | 16 |
| 52 | 28 | 12 |
| 40 | 8 | 4 |

FIG. 7C

FIG. 8A

| | | |
|---|---|---|
| 60 | 44 | 16 |
| 52 | 28 | 12 |
| 40 | 8 | 4 |

FIG. 8B

| (b-1) | | | (b-2) | | | (b-3) | | |
|---|---|---|---|---|---|---|---|---|
| 60 | 44 | 16 | 60 | 44 | 16 | 60 | 44 | 16 |
| 52 | 28 | 12 | 52 | 28 | 12 | 52 | 28 | 12 |
| 40 | 8 | 4 | 40 | 8 | 4 | 40 | 8 | 4 |

FIG. 8C

| (c-1) | | | (c-2) | | | (c-3) | | |
|---|---|---|---|---|---|---|---|---|
| 30 | 22 | 8 | 90 | 66 | 24 | 60 | 44 | 16 |
| 26 | 14 | 6 | 78 | 42 | 18 | 52 | 28 | 12 |
| 20 | 4 | 2 | 60 | 12 | 6 | 40 | 8 | 4 |

FIG. 11A

| | | |
|---|---|---|
| 60 | 44 | 16 |
| 52 | 28 | 12 |
| 40 | 8 | 4 |

FIG. 11B (b-1)

| | | |
|---|---|---|
| 90 | 66 | 24 |
| 78 | 100 | 18 |
| 60 | 12 | 6 |

(b-2)

| | | |
|---|---|---|
| 30 | 22 | 8 |
| 26 | 60 | 6 |
| 20 | 4 | 2 |

(b-3)

| | | |
|---|---|---|
| 60 | 44 | 16 |
| 52 | 80 | 12 |
| 40 | 8 | 4 |

FIG. 11C (c-1)

| | | |
|---|---|---|
| 30 | 22 | 8 |
| 26 | 60 | 6 |
| 20 | 4 | 2 |

(c-2)

| | | |
|---|---|---|
| 90 | 66 | 24 |
| 78 | 100 | 18 |
| 60 | 12 | 6 |

(c-3)

| | | |
|---|---|---|
| 60 | 44 | 16 |
| 52 | 80 | 12 |
| 40 | 8 | 4 |

FIG. 12A

| | | |
|---|---|---|
| 60 | 44 | 16 |
| 52 | 90 | 12 |
| 40 | 8 | 4 |

FIG. 12B

| (b-1) | | | (b-2) | | | (b-3) | | |
|---|---|---|---|---|---|---|---|---|
| 100 | 88 | 32 | 20 | 0 | 0 | 60 | 44 | 16 |
| 100 | 100 | 24 | 4 | 80 | 0 | 52 | 90 | 12 |
| 80 | 16 | 8 | 0 | 0 | 0 | 40 | 8 | 4 |

FIG. 12C

| (c-1) | | | (c-2) | | | (c-3) | | |
|---|---|---|---|---|---|---|---|---|
| 90 | 66 | 24 | 30 | 22 | 8 | 60 | 44 | 16 |
| 78 | 100 | 18 | 26 | 48 | 20 | 52 | 74 | 19 |
| 60 | 12 | 6 | 22 | 14 | 8 | 41 | 13 | 7 |

FIG. 12D

| (d-1) | | | (d-2) | | | (d-3) | | |
|---|---|---|---|---|---|---|---|---|
| 90 | 66 | 24 | 30 | 22 | 8 | 60 | 44 | 16 |
| 78 | 100 | 25 | 26 | 48 | 13 | 52 | 74 | 19 |
| 61 | 17 | 9 | 21 | 9 | 5 | 41 | 13 | 7 |

FIG. 13A

| | | |
|---|---|---|
| 60 | 44 | 16 |
| 52 | 80 | 12 |
| 40 | 8 | 4 |

FIG. 13B (b-1)

| | | |
|---|---|---|
| 100 | 80 | 29 |
| 94 | 100 | 22 |
| 72 | 15 | 8 |

(b-2)

| | | |
|---|---|---|
| 20 | 8 | 3 |
| 10 | 60 | 2 |
| 8 | 1 | 0 |

(b-3)

| | | |
|---|---|---|
| 60 | 44 | 16 |
| 52 | 80 | 12 |
| 40 | 8 | 4 |

FIG. 13C (c-1)

| | | |
|---|---|---|
| 90 | 66 | 24 |
| 78 | 100 | 18 |
| 60 | 12 | 6 |

(c-2)

| | | |
|---|---|---|
| 30 | 22 | 8 |
| 26 | 60 | 6 |
| 20 | 4 | 2 |

(c-3)

| | | |
|---|---|---|
| 60 | 44 | 16 |
| 52 | 64 | 12 |
| 40 | 8 | 4 |

FIG. 13D (d-1)

| | | |
|---|---|---|
| 60 | 44 | 16 |
| 52 | 28 | 12 |
| 40 | 8 | 4 |

(d-2)

| | | |
|---|---|---|
| 60 | 44 | 16 |
| 52 | 28 | 12 |
| 40 | 8 | 4 |

(d-3)

| | | |
|---|---|---|
| 60 | 44 | 16 |
| 52 | 28 | 12 |
| 40 | 8 | 4 |

FIG.14A (a-1)

| | | |
|---|---|---|
| 60 | 44 | 16 |
| 52 | 28 | 12 |
| 40 | 8 | 4 |

(a-2)

| | | |
|---|---|---|
| 16 | 36 | 64 |
| 12 | 24 | 60 |
| 4 | 16 | 24 |

FIG.14B (b-1)

| | | |
|---|---|---|
| 15 | 11 | 4 |
| 13 | 7 | 3 |
| 10 | 2 | 1 |

(b-2)

| | | |
|---|---|---|
| 90 | 66 | 24 |
| 78 | 42 | 18 |
| 60 | 12 | 6 |

(b-3)

| | | |
|---|---|---|
| 15 | 11 | 4 |
| 13 | 7 | 3 |
| 10 | 2 | 1 |

FIG.14C (c-1)

| | | |
|---|---|---|
| 4 | 9 | 16 |
| 3 | 6 | 15 |
| 1 | 4 | 6 |

(c-2)

| | | |
|---|---|---|
| 24 | 54 | 96 |
| 18 | 36 | 90 |
| 6 | 24 | 36 |

(c-3)

| | | |
|---|---|---|
| 4 | 9 | 16 |
| 3 | 6 | 15 |
| 1 | 4 | 6 |

FIG.14D (d-1)

| | | |
|---|---|---|
| 90 | 66 | 24 |
| 78 | 42 | 18 |
| 60 | 12 | 6 |

(d-2)

| | | |
|---|---|---|
| 19 | 20 | 20 |
| 16 | 13 | 18 |
| 11 | 6 | 7 |

(d-3)

| | | |
|---|---|---|
| 24 | 54 | 96 |
| 18 | 36 | 90 |
| 6 | 24 | 36 |

IMAGE DISPLAY METHOD

CROSS-REFERENCE TO RELATED APPLICATIONS

This application is a continuation of application Ser. No. 10/190,661, filed Jul. 9, 2002, now U.S. Pat. No. 6,970,148 and is based upon and claims the benefit of priority from the prior Japanese Patent Application No. 2001-209689, filed Jul. 10, 2001, the entire contents of which are incorporated herein by reference.

BACKGROUND OF THE INVENTION

1. Field of the Invention

The present invention relates to an image display method.

2. Description of the Related Art

Image display devices are roughly classified into impulse type display devices such as CRTs and hold type display devices such as LCDs (Liquid Crystal Displays). Impulse type display devices display images only while a phosphor is emitting light after the images have been written thereto. Hold type display devices hold an image in the preceding frame until a new image is written thereto.

A problem with the hold type display is a blur phenomenon that may occur when motion pictures are displayed. The blur phenomenon occurs because if a person observes a moving object on a screen, his or her eyes continuously follows the moving object though an image in the preceding frame remains displayed at the same position until it is switched to an image in the next frame. That is, in spite of the discontinuous movement of the moving object displayed on the screen, the eyes perceive the moving object in such a manner as to interpolate an image between the preceding and next frames because the following movement of the eyes is continuous. As a result, the blur phenomenon occurs.

To solve such a problem, a display method based on a field inversion system has been proposed (Jpn. Pat. Appln. KOKAI Publication No. 2000-10076) which utilizes such an operational characteristic of a monostable liquid crystal that one polarity allows the transmittance of light to be controlled in an analog manner, whereas the other polarity prevents light from being transmitted. With this display method based on the field inversion system, one frame is divided into two subfields. One of the subfields allows a liquid crystal to transmit light therethrough, whereas the other prevents the liquid crystal from transmitting light therethrough. A display method using bend alignment cell has also been proposed (Jpn. Pat. Appln. KOKAI Publication No. 11-109921). Both proposals provide periods when original images are displayed and periods when black images are displayed to approximate the impulse type display.

However, with the method based on the field inversion system, a voltage must be applied to a positive and negative polarities for an equal period so that no DC components remain in a liquid crystal layer. Consequently, the display has a duty ratio of 50%. In this case, the following definition is given: "duty ratio=display period/(display period+non-display period)×100".

With the method using bend alignment cell, to change the duty ratio, the number of dividing must be increased. Consequently, differences between signal line driving circuits make the display ununiform (a variation in brightness (i.e. luminance)). Further, a driving frequency for scanning lines must be changed in order to change the duty ratio. However, it is difficult to strictly set the duty ratio.

Furthermore, when the duty ratio is changed to increase the black display period, the brightness of the entire screen decreases. In this case, for a liquid crystal display device, the maximum brightness of a back light must be increased. However, this leads to an increase in power consumption. Moreover, if the duty ratio is varied by blinking the back light, flickers may occur unless the back light can blink stably.

Thus, with the conventional methods, providing black display periods may cause a decrease in screen brightness or the like. This may result in various problems.

On the other hand, color image display operations based on an additive color mixing system involve a spatial additive color mixing system and a field-sequentially additive color mixing system. With the spatial additive color mixing system, an R (Red) pixel, a G (Green) pixel, and a B (Blue) pixel which are adjacent to one another constitute one pixel so that the three-primary colors (R, G, and B) can be spatially mixed together. With the field-sequentially additive color mixing system, an R, G, and B images are sequentially displayed so that the three-primary colors can be mixed together in the direction of a time base. With this system, the R, G, and B images are mixed together at the same location. Consequently, it is possible to increase the resolution of the color image display device.

Field sequential color display operations utilizing the field-sequentially additive color mixing system involve various systems such as a color shutter system and a three-primary-color back light system. With any of these systems, an input image signal is divided into an R, G, and B signals. Then, the corresponding R, G, and B images are sequentially displayed within one frame period to achieve color display. That is, with a field sequential color display device, one frame is composed of a plurality of subfields that display R, G, and B images.

In general, a display device requires that one frame frequency is equal to or larger than a critical fusion frequency (CFF) at which no flickers are perceived. Accordingly, with the field sequential color display, when the number of subfields within one frame is defined as n, each subfield image must be displayed at a frequency n times as high as a frame frequency. For example, as shown in FIG. 24, if one frame frequency is 60 Hz and three subfields for R, G, and B are used to perform a field sequential color display operation, each subfield has a frequency of 180 Hz.

Methods for implementing a field sequential color display operation include the temporal switching of an RGB filter and the temporal switching of an RGB light source. Examples of the use of the RGB filter include a method of using a white light source to illuminate a light bulb and mechanically rotating an RGB color wheel and a method of displaying black and white images on a monochromatic CRT and providing a liquid crystal color shutter on a front surface of the CRT. An example of the use of the RGB light source is a method of illuminating a light bulb using an RGB LED or fluorescent lamp.

The field sequential color display operation must be performed at high speed. Accordingly, a light bulb for displaying images is composed of a quickly responsive DMD (Digital Micromirror Device), a bend alignment liquid crystal cell (including a PI twist cell and an OCB (Optically Compensated Birefringence) mode with phase compensating films added thereto), a ferroelectric liquid crystal cell using a smectic liquid crystal, an antiferroelectric liquid crystal cell, or a V-shaped responsive liquid crystal cell (TLAF (Thresholdless Anti-Ferroelectric) mode) exhibiting a voltage-transmittance curve indicative of a thresholdless V-shaped response. The light bulb may also be used for a liquid crystal cell used in a liquid crystal color shutter.

As described previously, in the field sequential color display operation, the lower limit on the subfield frequency at which no flickers are perceived is 3×CFF, i.e. about 150 Hz. It is known that a low subfield frequency may lead to "color breakup". This phenomenon occurs because an R, G, and B images do not coincide with one another on the retina owing to movement of the eyes following motion pictures or for another reason, thereby making the contour of the resulting image or screen appear colored.

For example, if an image signal for one frame has a frequency of 60 Hz, an R, G, and B subfield images are each displayed all over a display screen at a frequency of 180 Hz. If an observer is viewing a still image, an R, G, and B subfield images are mixed together on the observer's retina at a frequency of 180 Hz. The observer can thus view the correct color display. For example, when an image of a white box is displayed in the display screen, an R, G, and B subfields are mixed together on the observer's retina to present the correct color display to the observer.

However, if the observer's eyes move across the displayed image in the direction shown by the arrow in FIG. 23A, then as shown in FIG. 23B, at a certain instant, an R subfield image is presented to the observer, at the next instant, a G subfield image is presented to the observer, and at the next instant, a B subfield image is presented to the observer. Since the observer's eyes are moving across the display screen, the R, G, and B images do not perfectly coincide with one another on the observer's retina. Instead, the images are mixed together in such a manner as to deviate from one another. Thus, in the vicinity of an edge of a moving object, an R, G, and B subfields are not mixed together but individually appear. As a result, color breakup may occur. This is due to jumping movement of the eyes. Further, although the observer's eyes follow the moving object, each subfield image is displayed at the same location for one frame period. Accordingly, on the observer's retina, subfield images are mixed together in such a manner as to deviate from one another. As a result, the hold effect of the eyes may cause similar color breakup. Such a phenomenon strikes the observer as incongruous. Further, if the display device is used for a long time, the observer may be fatigued.

The color breakup caused by the jumping movement of the eyes can be suppressed by increasing the subfield frequency. However, this method fails to sufficiently suppress the color break up resulting from the hold effect. The color breakup resulting from the hold effect can be reduced by substantially increasing the subfield frequency. However, substantially increasing the subfield frequency creates a new problem. That is, loads on driving circuits for the display device may increase.

As described above, in the methods proposed to prevent motion pictures from blurring, one frame is divided into subfields used for image display and subfields used for black display. However, disadvantageously, the brightness of the image may generally decrease or the maximum brightness of the image must be increased. As a result, it is difficult to obtain high-quality images.

Further, if color images are displayed on the basis of the field-sequentially additive color mixing system by dividing one frame into a plurality of subfields, then possible color breakup makes it difficult to obtain high-quality images. Further, if the subfield frequency is increased to suppress the color breakup, loads on the driving circuits may disadvantageously increase.

It is an object of the present invention to provide an image display method that provides high-quality motion pictures.

BRIEF SUMMARY OF THE INVENTION

According to an aspect of the present invention, there is provided an image display method comprising: dividing an original image for one frame period into a plurality of subfield images; arranging the subfield images in a direction of a time axis in an order of brightness of the subfield images; and displaying the arranged subfield images in the order of the brightness.

BRIEF DESCRIPTION OF THE SEVERAL VIEWS OF THE DRAWING

FIG. 2B is a diagram showing an example of a configuration of a pixel of a liquid crystal display panel;

FIGS. 3A to 3C are diagrams showing alignments used if a liquid crystal is composed of an AFLC;

FIG. 4 is a diagram showing voltage-transmittance characteristics obtained if two polarizers are arranged in a liquid crystal display panel in a crossed-Nicole manner;

FIGS. 7A to 7C are diagrams showing another example of the brightness of each pixel according to a first embodiment of the present invention;

FIGS. 8A to 8C are diagrams showing an example of the brightness of each pixel according to a second embodiment of the present invention;

FIGS. 11A to 11C are diagrams showing an example of the brightness of each pixel according to a third embodiment of the present invention;

FIGS. 12A to 12D are diagrams showing an example of the brightness of each pixel according to a fourth embodiment of the present invention;

FIGS. 13A to 13D are diagrams showing an example of the brightness of each pixel according to a fifth embodiment of the present invention;

FIGS. 14A to 14D are diagrams showing another example of the brightness of each pixel according to the second embodiment of the present invention;

DETAILED DESCRIPTION OF THE INVENTION

Embodiments of the present invention will be described below with reference to the drawings.

FIRST EMBODIMENT

First, a first embodiment of the present invention will be described.

Figure 1:
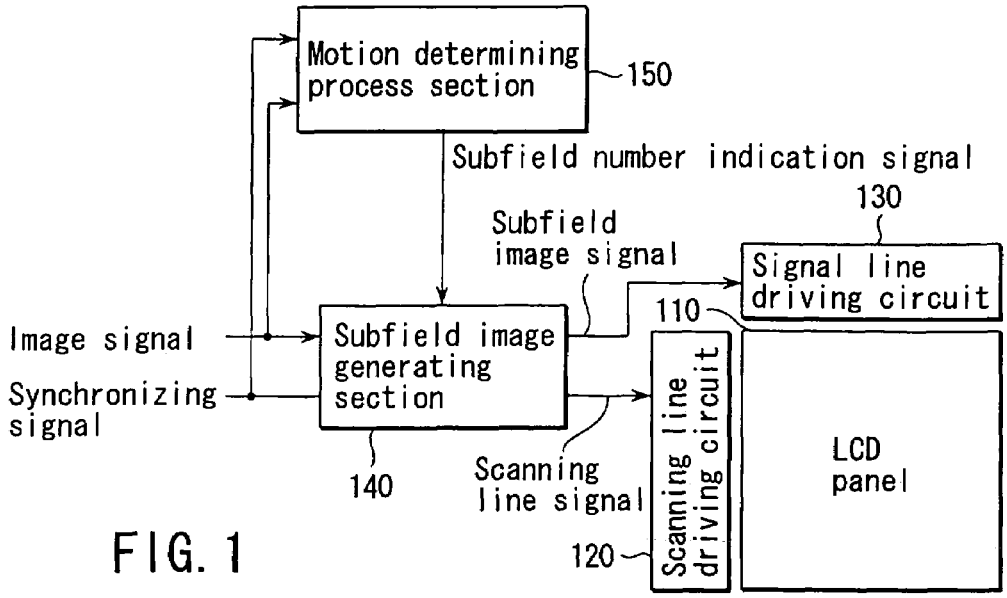
FIG. 1 is a block diagram schematically showing an example of the configuration of a liquid crystal display device according to a first to fifth embodiments of the present invention.
Figure 2A:
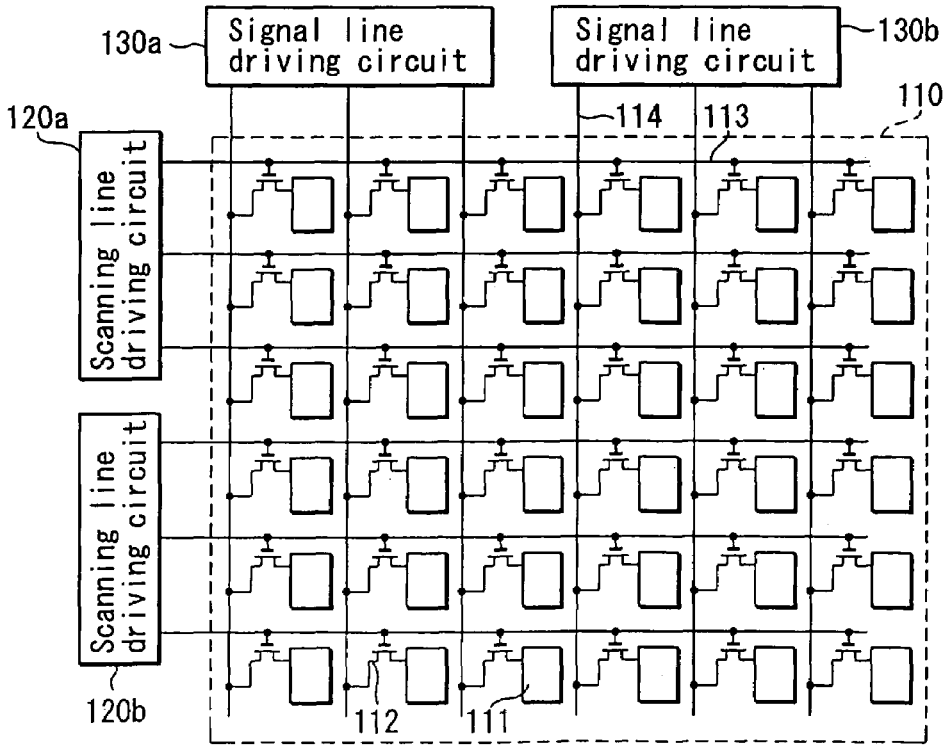
FIG. 2A is a diagram showing an example of the configuration of a liquid crystal display module section of the liquid crystal display device shown in FIG. 1.

FIG. 1 is a block diagram schematically showing the configuration of a liquid crystal display device according to embodiments of the present invention. FIG. 2A is a diagram showing the configuration of a liquid crystal display module section (a liquid crystal display panel and peripheral circuits), shown in FIG. 1.

The liquid crystal display module section is composed of a liquid crystal display panel 110, a scanning line driving circuit 120 (120*a*, 120*b*) and a signal line driving circuit 130 (130*a*, 130*b*). The scanning line driving circuit 120 is supplied with a scanning signal by a subfield image generating section 140. The signal line driving circuit 130 is supplied with a subfield image signal by a subfield image generating section 140. Further, an image signal and a synchronizing signal are input to the subfield image generating section 140 and a motion determining process section 150. The subfield image generating section 140 is supplied with a subfield number indication signal by the motion determining process section 150. These components will be described later in detail.

The configuration of the liquid crystal display panel 110 is basically similar to that of a typical liquid crystal display panel. That is, a liquid crystal layer is sandwiched between an array substrate and an opposite substrate. As shown in FIG. 2A, the array substrate comprises pixel electrodes 111, switching elements (each consisting of a TFT) 112 connected to the respective pixel electrode, scanning lines 113 connected to the switching elements 112 in the same row, and signal lines 114 connected to the switching elements 112 in the same column. The opposite substrate (not shown) comprises an opposite electrode (not shown) located opposite the array substrate. In the liquid crystal display panel 110, a pixel is composed of a red pixel (R pixel), a green pixel (G pixel), and a blue pixel (B pixel) on the basis of a spatial additive color mixing system, as shown in FIG. 2B.

The liquid crystal may be composed of any material. However, the material is preferably quickly responsive because the display must be switched a plurality of times within one frame period. Examples of the material include a ferroelectric liquid crystal material, a liquid crystal material (for example, anti-ferroelectric liquid crystal (AFLC)) having spontaneous polarization induced upon application of an electric field, and a bend alignment liquid crystal cell. The liquid crystal display panel is set to a mode in which light is not transmitted therethrough while no voltage is applied (normally black mode) or a mode in which light is transmitted therethrough while no voltage is applied (normally white mode), depending on the combination of two polarizers.

FIGS. 3A, 3B, and 3C showing alignments used if the liquid crystal is composed of an AFLC. FIG. 4 shows voltage-transmittance characteristics obtained if the two polarizers are arranged on the liquid crystal display panel in a crossed-Nicole manner.

As shown in FIG. 3A, while no voltage is applied, liquid crystal molecules 115 are arranged so as to cancel the spontaneous polarization. Since no light is transmitted through the liquid crystal, a black display is provided. In FIG. 3B (a positive voltage is applied) and FIG. 3C (a negative voltage is applied), the liquid crystal molecules are arranged in one direction so as to allow light to pass therethrough. Further, as shown in FIG. 4, in addition to the three alignment states, i.e. the no-voltage application state, positive-voltage application state, and negative-voltage application state, an intermediate alignment state can be established depending on the magnitude of a voltage applied between the electrodes.

The operation of this embodiment will be described below.

Figures 5, 6A, 6B, 6C, 6D:
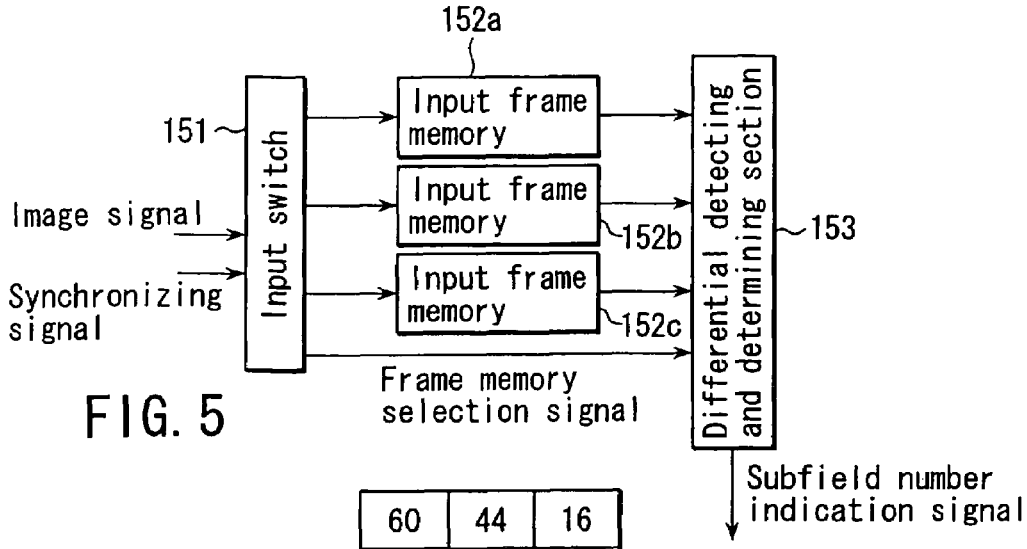
FIG. 5 is a diagram showing an example of the configuration of a motion determining process section, shown in FIG. 1.
FIGS. 6A to 6D are diagrams showing an example of the brightness of each pixel according to a first embodiment of the present invention.

As shown in FIG. 1, an externally input image and synchronizing signals are input to both subfield image generating section 140 and motion determining process section 150. The motion determining process section 150 determines whether the input image is a motion picture or a still image. FIG. 5 shows an example of the motion determining process section 150.

In the example shown in FIG. 5, images are repeatedly input to frame memories 152*a*, 152*b*, and 152*c* via an input switch 151. For example, an image signal is input to the frame memory 152*a*, and then an image signal is input to the frame memory 152*b*. Then, simultaneously with the input of an image signal to the frame memory 152*c*, a differential detecting and determining section 153 examines the correlation between the image in the frame memory 152*a* and the image in the frame memory 152*b*. The frames for which the correlation is examined is determined by transmitting a frame memory selection signal from the input switch 151 to the differential detecting and determining section 153. The frame memory selection signal indicates the frame memory in which image signal has been input. That is, the correlation between frame memories that have not been selected (that have not been indicated by the signal) is examined. Differential detection may be carried out for the entire screen or for each block. Further, instead of examining all bits for red (R), green (G), and blue (B), higher bits alone may be examined. On the basis of the magnitude of a differential signal obtained, it is determined whether the image is a fast moving motion picture, a slow moving motion picture, or a still image.

The determination result thus obtained is transmitted to the subfield image generating section 140 as a subfield number indication signal. Upon receiving the subfield number indication signal, the subfield image generating section 140 transmits a plurality of subfield image signals, a horizontal synchronizing signal (hereinafter referred to as an "STH"), a horizontal clock (hereinafter referred to as an "Hclk"), a scanning signal vertical synchronizing signal (hereinafter referred to as an "STV"), and a vertical clock (hereinafter referred to as a "Vclk") to a liquid crystal display module.

When the STV is input to the scanning line driving circuit 120, a shift register in the scanning line driving circuit 120 latches it. Subsequently, the Vclk sequentially shifts the STV. Then, image data are written to the pixels connected to the scanning line for which the STV indicates a high level.

In this system, the time required to write image data to the screen varies depending on the subfield number indication signal. For example, if the number of subfields is defined as n, the vertical and horizontal clocks have a width of 1/n compared to the case in which one frame is written using one subfield. Further, the width of the synchronizing signal varies correspondingly.

Now, a processing method executed by the subfield image generating section 140 will be described. The subfield image generating section 140 has two frame memories. One of the frame memories is used to generate subfield images, while the other is used to store an image in the next frame while subfield images are being generated. The frame memories of the motion determining process section 150 may also be used for the subfield image generating section 140.

Now, for simplification of description, a 3×3 matrix image will be described. It is also assumed that brightness (i.e. luminance) is 100 when the liquid crystal display panel has a maximum transmittance and that the number of subfields n is 2.

FIG. 6A shows the brightness of the pixels of an input image. As shown in FIG. 6B, if the brightness of the first subfield (b-1) is the same as the brightness of the second subfield (b-2), the average brightness of one frame is as shown in (b-3). On the other hand, as shown in FIG. 6C, if the brightness of the first subfield (c-1) is the same as the brightness of the input image and the second subfield is a black image (c-2), then the average brightness of one frame is reduced to half as shown in (c-3).

Thus, in this example, the brightness ratio R of the brightness of the first subfield image (d-1) to the brightness of the second subfield image (d-2) (the brightness ratio R will hereinafter be defined by the brightness of the m-th subfield image/the brightness of the m+1-th subfield image) is set to 3:1 (R=3), as shown in FIG. 6D. In this case, the average brightness of one frame is as shown in (d-3).

FIGS. 7A to 7C show another example of this embodiment wherein the number of subfields n is four. FIG. 7A shows the brightness of the pixels of an input image. In FIG. 7B, images with the same brightness are displayed in the first to fourth subfields (b-1) to (b-4), respectively. The average brightness of one frame is as shown in (b-5). In this example, as shown in FIG. 7C, the brightness ratios R between the subfields (c-1) and (c-2), between the subfields (c-2) and (c-3), and between the subfields (c-3) and (c-4) are each 1.5, and the average brightness is as shown in (c-5). Any remainder of the division between two brightness values is assigned to the corresponding brightness in the fourth subfield (c-4).

As described above, in this embodiment, the subfield image generating section divides an input image for one frame period into a plurality of subfield images and arranges the subfield images in the direction of the time base in the order of the magnitude of brightness. In this case, the brightness is reallocated among the subfields so that the average of the brightness of the subfield images within one frame period is the same as the brightness of the input image. This method prevents motion pictures from blurring without reducing the brightness of the images. Therefore, high-quality images are obtained.

SECOND EMBODIMENT

Now, a second embodiment of the present invention will be described.

In this embodiment, compared to the first embodiment, the first subfield has the lowest brightness, and the subsequent fields have a sequentially increasing brightness.

FIGS. 8A, 8B, and 8C show an example of this embodiment. As in the example shown in FIGS. 6A to 6D, FIG. 8A shows the brightness of the pixels of an input image. FIG. 8B shows an example in which images with the same brightness are displayed in the first and second subfields, respectively. In this example, a first and second subfield images (c-1) and (c-2) are generated in a brightness ratio R of 1/3 so that the average brightness is as shown in (c-3), as shown in FIG. 8C. Any remainder of the division between the two brightness values is added to or subtracted from the corresponding brightness in the first subfield.

The occurrence of color noise differs between the method of gradually increasing the brightness as in this embodiment and the method of reducing the brightness as in the first embodiment. By way of example, description will be given of the case in which the image shifts from a dark part to a light part and then to a dark part again. FIG. 9 shows the use of the method of the first embodiment. FIG. 10 shows the use of the method of the second embodiment. In the figures, edges are emphasized but are assumed to have a small brightness gradient. Further, with a still image, the first and second embodiments produce the same results. Accordingly, description will be given of a motion picture in which an edge moves rightward within the screen.

Figure 9A:
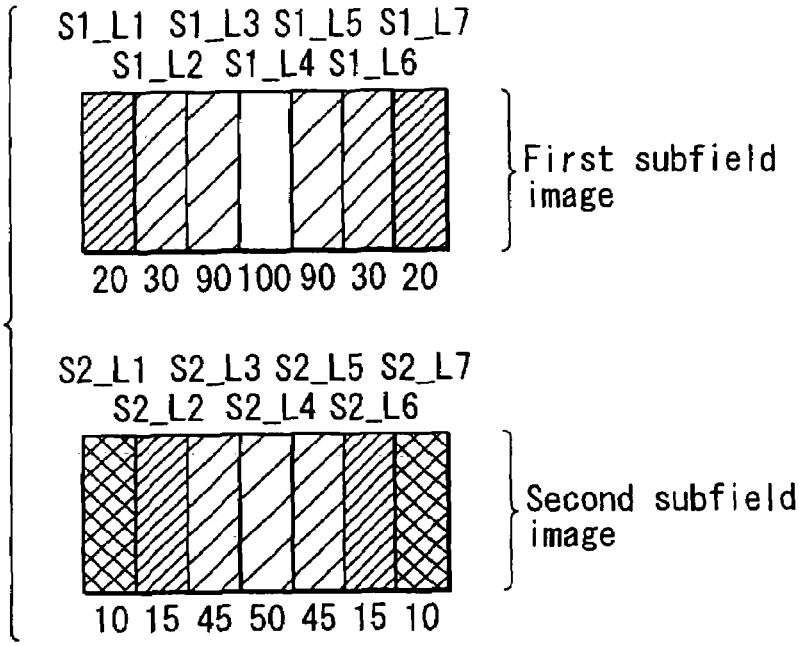
FIGS. 9A and 9B show an example of a display and the motion of the eye point obtained according to the first embodiment of the present invention.
Figure 9B:
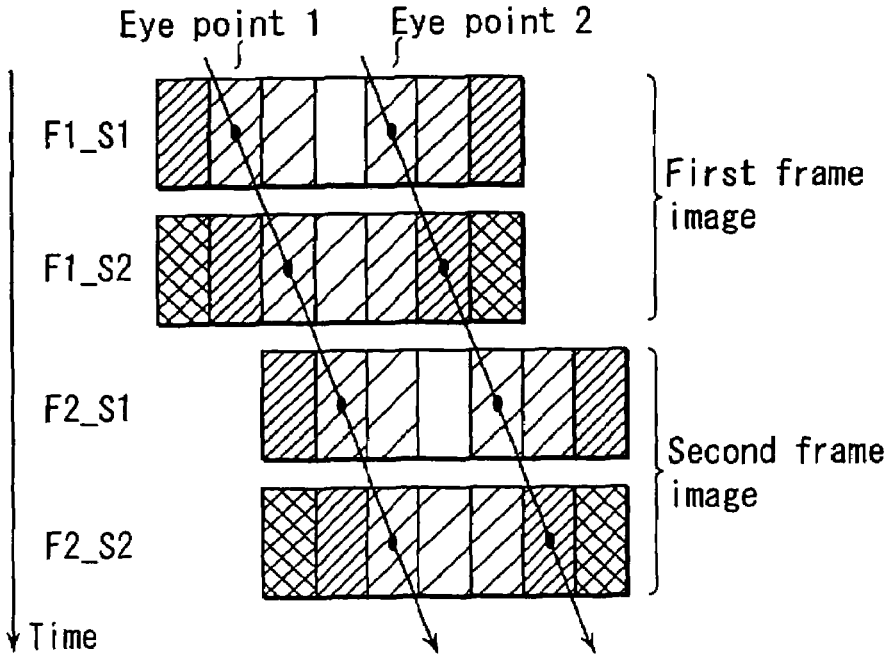

As shown in FIG. 9A, in the first embodiment, a high-brightness image is displayed in the first subfield, and an interpolation image is displayed in the second subfield. The brightness ratio R is set to 2. In each figure, symbols representative of the positions of the areas of the subfield image (for example, in the first subfield, the leftmost area is represented as S1_L1) are shown over the image, while the brightness is shown under the image. FIG. 9B shows images displayed in the direction of the time base. The symbols shown by the side of the time base indicate frame numbers and subfield numbers (for example, the first subfield of the first frame is represented as F1_S1).

Figure 10A:
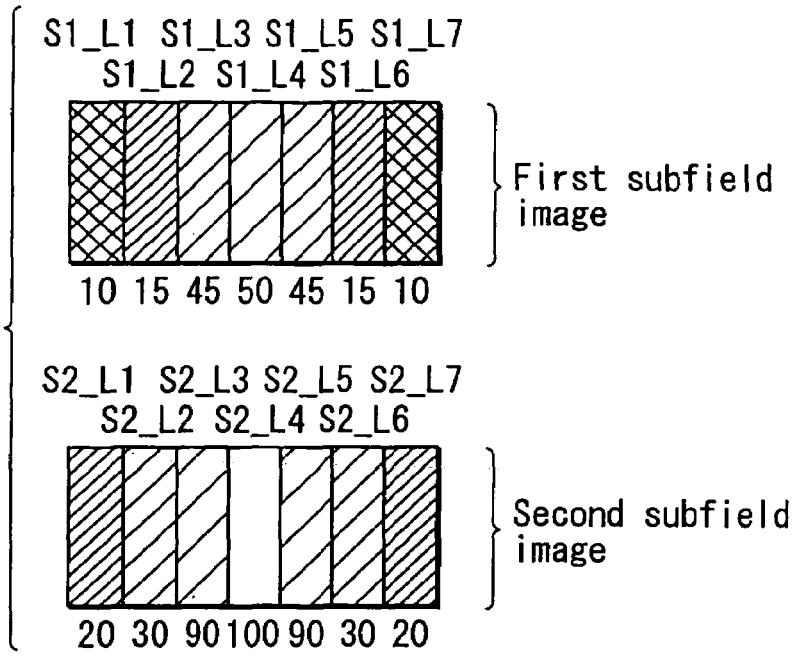
FIGS. 10A and 10B show an example of a display and the motion of the eye point obtained according to the second embodiment of the present invention.
Figure 10B:
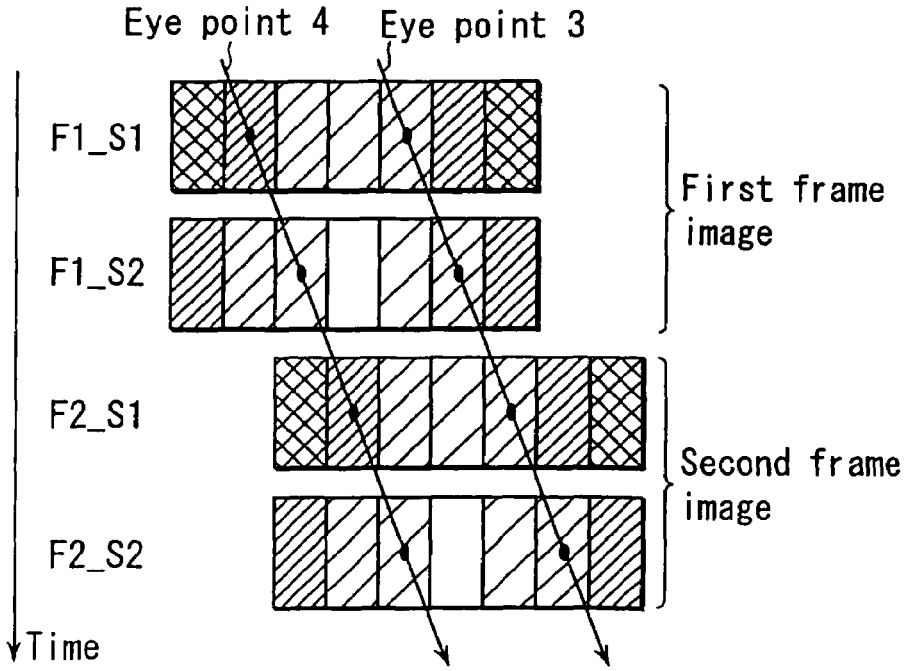

Similar notation is used in FIGS. 10A and 10B (the method of the second embodiment). In the example shown in FIGS. 10A and 10B, the first subfield is an interpolation image, and the second subfield is a high-brightness image. The brightness ratio is 1/2.

In FIGS. 9B and 10B, eye points 1 and 3 indicate that the observer is viewing a darker edge, whereas eye points 2 and 4 indicate that the observer is viewing a brighter edge. Incorrect information may be loaded if the observer views the brighter edge in the second subfield though he or she views the darker edge in the first subfield or if the observer views the darker edge in the second subfield though he or she views the brighter edge in the first subfield.

In FIGS. 9B and 10B, the observing positions of the eye points 1 to 4 are:

Eye point 1: S1_L2→S2_L3→S1_L2→S2_L3

Eye point 2: S1_L5→S2_L6→S1_L5→S2_L6

Eye point 3: S1_L5→S2_L6→S1_L5→S2_L6

Eye point 4: S1_L2→S2_L3→S1_L2→S2_L3

The eye points 1 and 3 have a small difference between the high-brightness image and the interpolation image. As a result, the observer has an insignificant sense of interference. On the other hand, the eye points 2 and 4 have a large difference between the high-brightness image and the interpolation image. As a result, the observer has a significant sense of interference. Consequently, in the first embodiment (FIGS. 9A and 9B), interference may occur at the eye point 2. In the second embodiment (FIGS. 10A and 10B), interference may occur at the eye point 4.

The above described phenomenon most often occurs in general motion pictures, though the occurrence depends on a displayed object and the amount of movement of the object.

Here, in view of the temporal attenuation of the brightness of light with which the retina is irradiated, the difference described below may occur between the first embodiment (FIGS. 9A and 9B) and the second embodiment (FIGS. 10A and 10B). For example, it is assumed that the eye point shifts from the second subfield of the first frame (F1_S2) to the first subfield of the second frame (F2_S1). In the first embodiment, the brightness of the interpolation image (F1_S2) is observed attenuating while the high-brightness image (F2_S1) is being observed. Thus, at the eye point 2, the brightness difference between the high-brightness image and the interpolation image increases. On the other hand, in the second embodiment, the brightness of the high-brightness image (F1_S2) is observed decreasing to half while the interpolation image (F2_S1) is being observed. Thus, at the eye point 4, the brightness difference between the high-brightness image and the interpolation image decreases. Although the exact rate of a decrease in brightness on the retina is unknown, the results of the inventors' experiments indicate that the second embodiment provides images that give the observer a more insignificant sense of interference.

Next, a method of reducing the above described interference will be described.

In the above described example, the interpolation image components within one frame are distributed to only one of the preceding and next fields of the high-brightness image. However, these components may be distributed to both preceding and next fields. FIGS. 14A to 14D shows an example.

(a-1) in FIG. 14A shows the brightness of the pixels of the first frame image. (a-2) shows the brightness of the pixels of the second frame image.

For example, as shown in FIG. 14B, for the first frame, a high-brightness image (b-2) and an interpolation image are generated in a brightness ratio of 3. However, the brightness components to be allocated to the interpolation image are distributed to the preceding field (b-1) and the next field (b-3). In this case, the components are equally distributed to these two fields. Likewise, for the second frame, as shown in FIG. 14C, a high-brightness image and an interpolation image are generated in a brightness ratio of 3. The interpolation image is equally distributed to the preceding and following fields. Thus, as shown in FIG. 14D, an interpolation image (d-2) sandwiched between a high-quality image in the first frame (d-1) and a high-quality image in the second frame (d-3) corresponds to the sum of the next field interpolation image for the first frame (b-3) and the preceding field interpolation image for the second frame (c-1).

In this case, some pixels of the interpolation image may have a higher brightness than the pixels of the high-brightness image. However, during a high-brightness image and an interpolation image are generated for one frame, the high-brightness image is set to have a higher brightness than the interpolation image as in the method described previously. The results of the inventor's experiments indicate that this display method also provides images that give the observer a more insignificant sense of interference.

THIRD EMBODIMENT

Now, a third embodiment of the present invention will be described.

The brightness in the screen may have a varying value. Accordingly, brightness may be set which exceeds the range of brightness at which the display device can display images. For pixels for which such brightness is set, the maximum possible brightness is set for a high-brightness image, whereas a brightness component exceeding the maximum brightness is set for an interpolation image.

FIGS. 11A to 11C show an example of this embodiment. As in the example shown previously, FIG. 11A shows the brightness of the pixels of an input image. FIG. 11B shows the case in which the brightness ratio R is set to 3. FIG. 11C shows the case in which the brightness ratio R is set to 1/3. In the description given below, the coordinates of the upper left pixel are defined as (0, 0) for convenience.

For example, as shown in FIG. 11A, it is assumed that the central pixel (coordinates (1, 1)) has a brightness of 80. In the example shown in FIG. 11B, the first subfield is assigned with the maximum brightness of 100 and the second subfield is assigned with a brightness of 60 so that the average brightness of one frame is as shown in (b-3). In the example shown in FIG. 1C, the first subfield is assigned with a brightness of 60 and the second subfield is assigned with the maximum brightness of 100 so that the average brightness of one frame is as shown in (c-3).

Thus, in this embodiment, if the brightness cannot be set for the subfields according to the desired brightness ratio, then the maximum possible brightness is set for a high-brightness image. Therefore, effects similar to those of the first embodiment and others can be produced without using a display device with a high brightness.

FOURTH EMBODIMENT

Next, a fourth embodiment of the present invention will be described.

In this description, the brightness of subfield images sequentially decrease as in the first embodiment. However, the method of this embodiment is applicable to the case in which the brightness of subfield images sequentially increase as in the second embodiment.

FIGS. 12A to 12D show an example of this embodiment. As in the examples shown previously, FIG. 12A shows the brightness of the pixels of an input image. Further, (b-1), (c-1), and (d-1) denote the brightness of the pixels of the first subfield. (b-2), (c-2), and (d-2) denote the brightness of the pixels of the second subfield. (b-3), (c-3), and (d-3) denote the average brightness of the respective pixels over one frame.

For example, the brightness of the input image is multiplied by the number of subfields (in this case, 2). The value obtained is assigned to the first subfield. In this case, as shown in FIG. 12B, three pixels have brightness exceeding the maximum achievable brightness of 100. Then, some images may have brightness inadequately distributed, resulting in non-correlated colors. Thus, in this embodiment, a brightness component exceeding the maximum possible value (this component corresponds to a differential value) is assigned to the adjacent pixels in the high-brightness image or interpolation image.

In the example shown in FIG. 12C, a high-brightness image (c-1) and an interpolation image (c-2) are generated in a brightness ratio of 3. In this case, for example, for the pixel (1, 1), the high-brightness image component has a brightness of 135. Thus, the differential value of 35 (=135−100) is assigned to the interpolation image. For example, the differential value of 35 divided by 16 leaves a remainder of 3. This remainder of 3 is assigned to the pixel (1, 1) in the interpolation image to obtain a brightness of 48 (45+3). The remaining value 32 is assigned to the pixels (1, 2), (2, 0), (2, 1), and (2, 2) in allocation ratios of 7/16, 1/16, 5/16, and 3/16. For example, the pixel (1, 2) has a brightness of 6+32×(7/16)=20, and the pixel (2, 0) has a brightness of 20+32×(1/16)=22. The allocated amount (right side) and allocation ratio (shown in the parentheses on the right side) of each pixel (left side) are shown below.

(0, 0)=0 (0)
(0, 1)=0 (0)
(0, 2)=0 (0)
(1, 0)=0 (0)
(1, 1)=3 (0)
(1, 2)=14 (7/16)
(2, 0)=2 (1/16)
(2, 1)=10 (5/16)
(2, 2)=6 (3/16)

(c-2) in FIG. 12C show the results of this allocation.

In the example shown in FIG. 12D, the differential value is assigned to the adjacent pixels in the high-brightness image as well as to the interpolation image. The allocated amount and allocation ratio in the high-brightness image (first subfield: (d-1)) and interpolation image (second subfield: (d-2)) are shown below.

<First Subfield>
(0, 0)=0 (0)
(0, 1)=0 (0)
(0, 2)=0 (0)
(1, 0)=0 (0)
(1, 1)=0 (0)
(1, 2)=7 (7/32)
(2, 0)=1 (1/32)
(2, 1)=5 (5/32)
(2, 2)=3 (3/32)
<Second Subfield>
(0, 0)=0 (0)
(0, 1)=0 (0)
(0, 2)=0 (0)
(1, 0)=0 (0)
(1, 1)=3 (0)
(1, 2)=7 (7/32)
(2, 0)=1 (1/32)
(2, 1)=5 (5/32)
(2, 2)=3 (3/32)

Thus, in this embodiment, the differential value is assigned to the adjacent pixels, thereby obtaining images having decreased non-uniformity of brightness.

In the first to fourth embodiments, the brightness ratio R may be determined beforehand. However, the following equation may be used:

Brightness ratio $R$=the maximum possible brightness/the average screen brightness In this case, the frame memories in the motion determining process section can be used to determine the average brightness of one frame.

FIFTH EMBODIMENT

Now, a fifth embodiment of the present invention will be described.

In this embodiment, the brightness ratio R is varied on the basis of the results of processing executed by the motion determining process section 150, shown in FIG. 1. For example, the brightness ratio R is set at 9 for a fast-moving motion picture, at 3 for a slow-moving motion picture, and at 1 for a still image.

FIG. 13 shows an example of this embodiment. As in the example shown previously, FIG. 13A shows the brightness of the pixels of an input image. FIG. 13B shows a fast moving image. FIG. 13C shows a slow moving image. FIG. 13D shows a still image. (b-1), (c-1), and (d-1) denote the brightness of the pixels of the first subfield. (b-2), (c-2), and (d-2) denote the brightness of the pixels of the second subfield. (b-3), (c-3), and (d-3) denote the average brightness of the respective pixels over one frame.

Any method may be used to calculate brightness for each subfield. For example, calculations can be executed in the following manner: first, the brightness of each pixel in the input image is multiplied by the number of subfields (in this case, 2). The value obtained by the multiplication is divided by R+1 to determine brightness for the second subfield (decimals are omitted). Next, the brightness for the second subfield is subtracted from the brightness obtained by the multiplication to determine a brightness for the first subfield. At this time, if the brightness for the first subfield exceeds the maximum brightness, the difference between these two values (differential value) is added to the already determined brightness for the second subfield. With this method, for example, the brightness of the pixel (0, 0) can be calculated as follows:

In FIG. 13B (R=9),

Input image brightness (60)×the number of subfields (2)=120

$120/(R+1)=12$ $120-12=108$ $108-100+12=20.$

Consequently, the brightness for the first subfield is 100, and the brightness for the second subfield is 20.

In FIG. 13C (R=3),

Input image brightness (60)×the number of subfields (2)=120

$120/(R+1)=30$ $120-30=90.$

Consequently, the brightness for the first subfield is 90, and the brightness for the second subfield is 30.

In FIG. 13D (R=1),

Input image brightness (60)×the number of subfields (2)=120

120/(R+1)=60

120−60=60

Consequently, the brightness for the first subfield is 60, and the brightness for the second subfield is 60.

In the above described first to fifth embodiments, the liquid crystal display device, a typical example of a hold type display device, is described. However, these embodiments are applicable to organic ELDs (electroluminescence displays) having a memory capability. Further, in the first to fifth embodiments, the color image display based on the spatial additive color mixing system is described. However, these embodiments are applicable to a monochromatic image display.

As described above, according to the first to fifth embodiments, in the hold type display device, an image in one frame is divided into a plurality of subfield images. Then, the subfield images are rearranged in the order of increasing or decreasing brightness. Further, compared to the prior art, no non-display periods are provided, thereby hindering brightness from decreasing. This prevents motion pictures from blurring without substantially reducing the screen brightness. Therefore, high-quality images are obtained.

SIXTH EMBODIMENT

Next, a sixth embodiment will be described.

Figure 15:
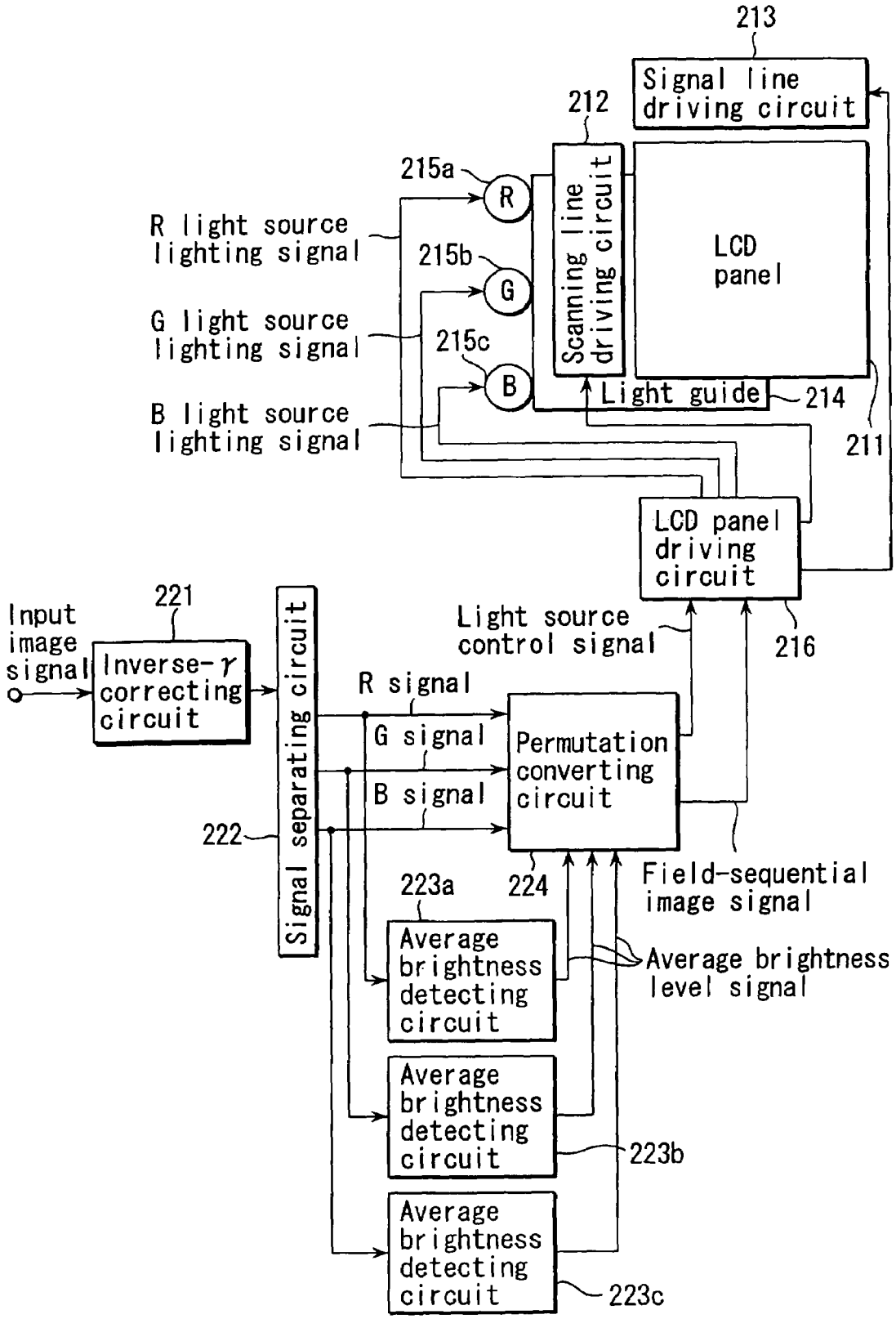
FIG. 15 is a block diagram schematically showing an example of the configuration of a liquid crystal display device according to a sixth embodiment of the present invention.

FIG. 15 is a block diagram schematically showing an example of the configuration of a liquid crystal display device according to this embodiment.

The configuration of a liquid crystal display panel 211 is basically similar to, for example, that shown in FIG. 2A. That is, the liquid crystal display panel 211 is driven by a scanning line driving circuit 212 and a signal line driving circuit 213. Further, the liquid crystal display panel 211 is illuminated by a red light source 215*a*, a green light source 215*b*, and a blue light source 215*c* via a light guide 214. The liquid crystal display panel driving circuit 216 controls the light sources 215*a* to 215*c* as well as the scanning line driving circuit 212 and the signal line driving circuit 213. Color images are displayed on the basis of a field-sequentially additive color mixing system by lighting the light sources 215*a* to 215*c* in a field sequential manner. The liquid crystal display panel driving circuit 216 receives field-sequential image signals generated by an inverse-γ correcting circuit 221, a signal separating circuit 222, average brightness detecting circuits 223*a* to 223*c*, a permutation converting circuit 224, and others.

The configuration and operation of this embodiment will be described below in detail.

An input image signal is subjected to inverse-γ corrections by the inverse-γ correcting circuit 221 and is then separated into an R, G, and B image signals by the signal separating circuit 222.

The separated R, G, and B signals are input to the average brightness detecting circuits 223*a*, 223*b*, and 223*c* to detect the average brightness level of each of the R, G, and B signals in one frame period. The average brightness level signals from the average brightness detecting circuits 223*a*, 223*b*, and 223*c* are input to the permutation converting circuit 224 together with the separated R, G, and B signals.

The permutation converting circuit 224 has a frame buffer. This frame buffer is used to arrange the R, G, and B signals in the order of increasing or decreasing average brightness level. The permutation converting circuit 224 outputs the R, G, and B signals as field sequential image signals at a frequency three times as high as the frame frequency of the input image signal. Then, the liquid crystal display panel driving circuit 216 receives the field sequential image signals and a light source control signal indicative of the permutation of the R, G, and B signals.

The liquid crystal display panel driving circuit 216 displays an image obtained from the field sequential image signals on the monochromatic liquid crystal display panel 211. Synchronously with this display, the R, G, and B light sources 215*a* to 215*c* are lighted on the basis of the light source control signal. For example, if the permutation converting circuit 224 determines that a display operation be performed in the order of G, R, and B, the liquid crystal display panel driving circuit 216 performs the following operation: first, a G image signal is output, and the G light source 215*b* is lighted synchronously with the display of the G image on the liquid crystal display panel 211. Then, an R image signal is output, and the R light source 215*a* is lighted synchronously with the display of the R image on the liquid crystal display panel 211. Subsequently, a B image signal is output, and the B light source 215*c* is lighted synchronously with the display of the B image on the liquid crystal display panel 211.

The light sources 215*a* to 215*c* may be composed of cold cathode fluorescent lamps, LEDs, or various other light sources. However, the light sources 215*a* to 215*c* are desirably quickly responsive and are composed of LEDs in this embodiment.

Figure 16A:
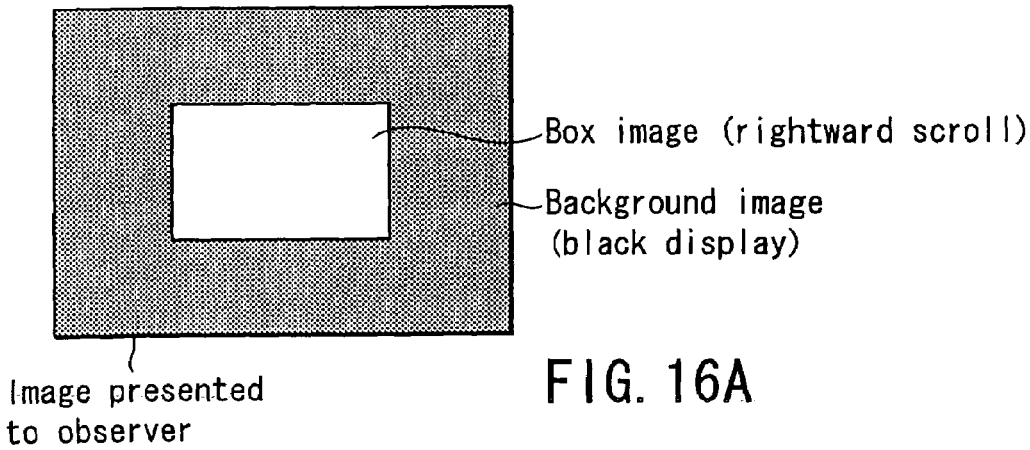
FIGS. 16A to 16C are diagrams showing a color breakup reduction effect according to the sixth embodiment of the present invention.
Figure 16B:
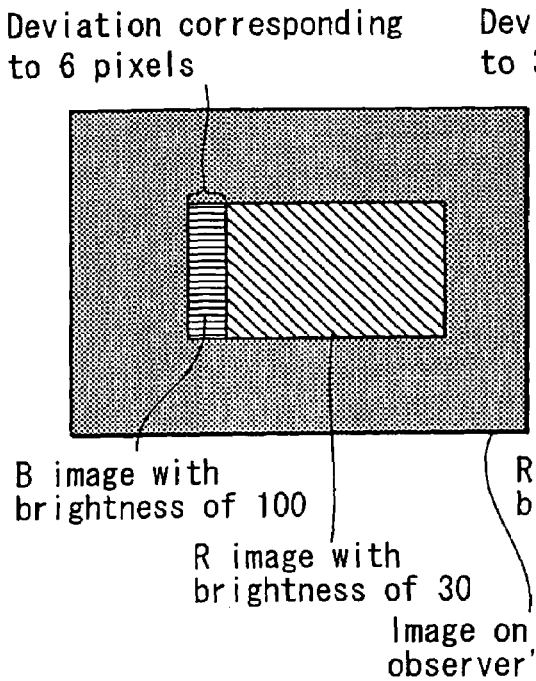
Figure 16C:
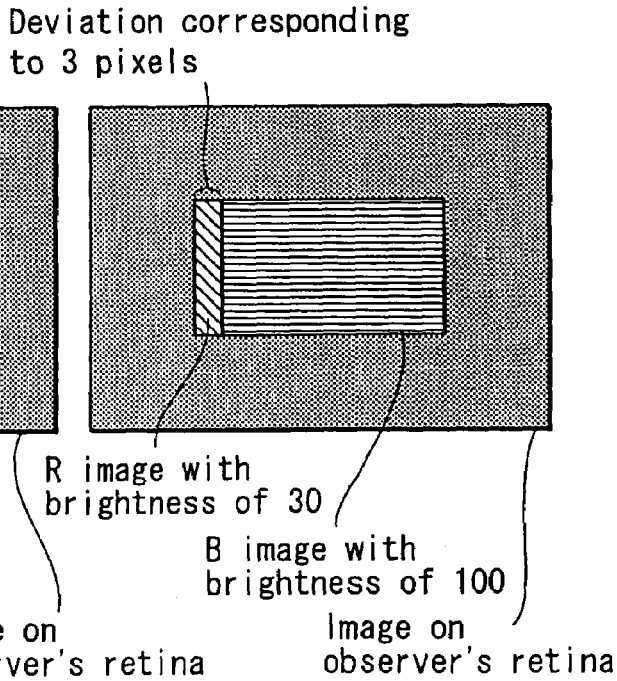

Now, suppression of color breakup resulting from the hold effect will be described with reference to FIGS. 16A, 16B, and 16C. FIGS. 16A, 16B, and 16C show that a box image with an R brightness of 30, a G brightness of 0, and a B brightness of 100 is scrolled rightward on the black background of the screen at a speed of nine pixels per frame.

If the observer's eyes are following the moving object (in this example, the box image), they move smoothly so as to follow the moving object. On the other hand, the position at which the moving object is displayed within one frame period remains unchanged between subfields. Thus, on the observer's retina, the subfield images are mixed together in such a manner as to deviate from each other. Consequently, color breakup occurs near an edge of the moving object.

FIG. 16B shows that a motion picture such as the one described above is displayed in a field sequential manner in the order of R, G, and B. That is, on the observer's retina, a positional deviation corresponding to two-thirds of one frame period (which in turn corresponds to six pixels) occurs between the R and B subfields. On the other hand, if the subfield images are displayed in a field sequential manner in a descending order on the basis of the average brightness levels of the R, G, and B images, then the image is displayed in the order of B, R, and G. As a result, as shown in FIG. 16C, the positional deviation between the R and B subfields decreases to one-third of one frame period (i.e. three pixels). Accordingly, color breakup resulting from the hold effect can be suppressed by changing the display order on the basis of the average brightness levels of the R, G, and B images.

In the above example, the G image has an average brightness level of zero. Even if all of the R, G, and B images have an average brightness level higher than zero, the observer more easily perceives color breakup between subfield images having higher average brightness levels than color breakup between subfield images having lower average brightness levels. Therefore, also in this case, effects similar to those described above can be produced by displaying the subfield images in an ascending or descending order on the basis of the average brightness level.

Further, if the display order of the subfields is changed during the display of the series of the motion picture, the observer may be struck as incongruous because of flickers or the like. In such a case, for example, a scene change detecting circuit may be used to detect a scene change in the motion picture so as to change the display order of the subfield images only if a scene change is detected. Several methods may be used to detect a scene change. For example, the correlation between images in two temporally adjacent frames may be examined so as to determine that the scene has changed if the level of the correlation decreases.

SEVENTH EMBODIMENT

A seventh embodiment of the present invention will be described.

Figure 17:
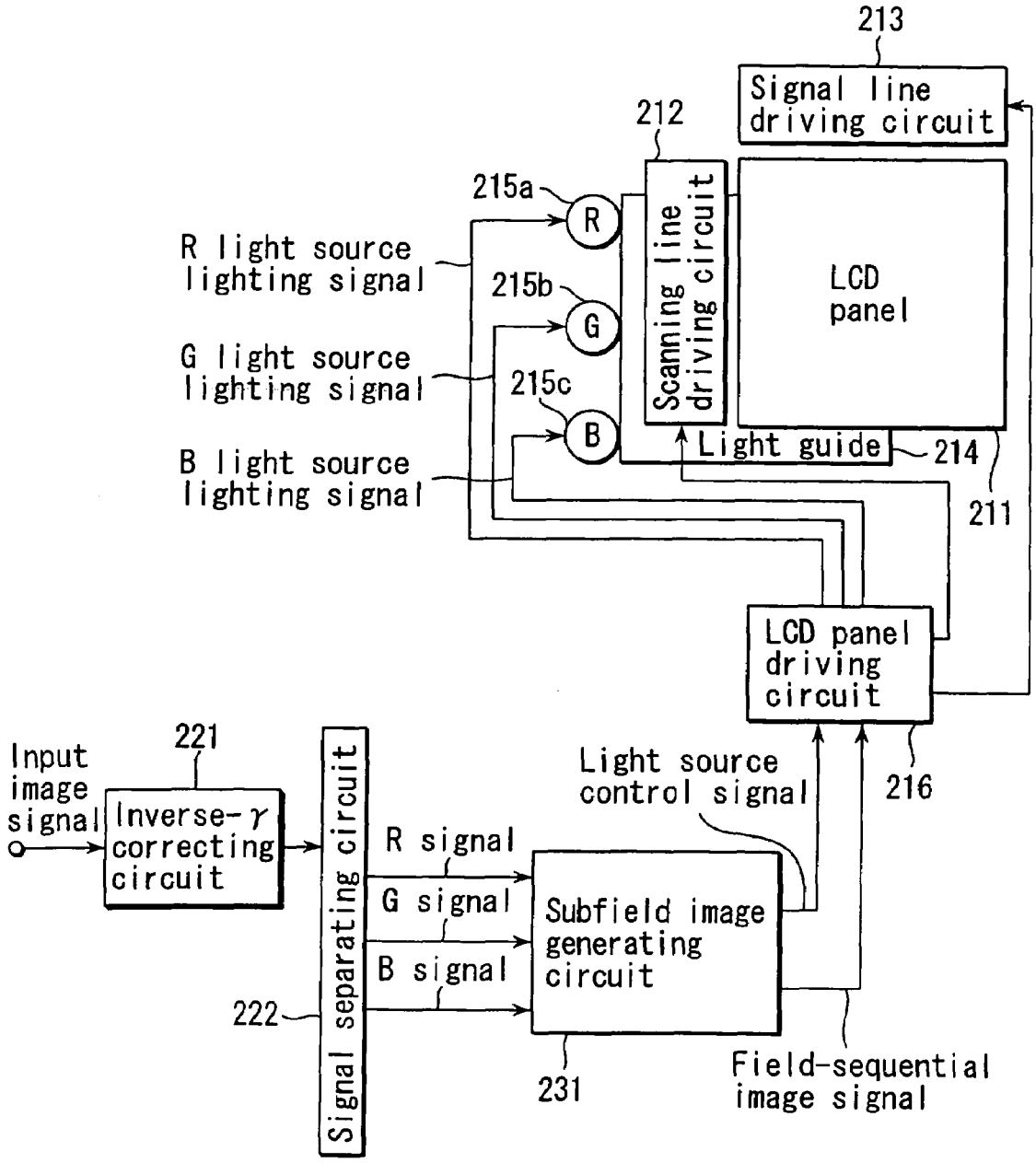
FIG. 17 is a block diagram schematically showing an example of the configuration of a liquid crystal display device according to a seventh embodiment of the present invention.

FIG. 17 is a block diagram schematically showing an example of the configuration of a liquid crystal display device according to this embodiment. This configuration is basically similar to the configuration of FIG. 15 described in the sixth embodiment, in spite of a partial difference therebetween. The configuration and operation of this embodiment will be described below.

In this embodiment, to be more specific, it is assumed that an input image signal has a frame frequency of 60 Hz and that the subfield frequency is six times as high as the frame frequency of the input image signal (360 Hz).

The input image signal is subjected to inverse-γ corrections by the inverse-γ correcting circuit 221 and is then separated into an R, G, and B image signals by the signal separating circuit 222. Furthermore, the separated R, G, and B signals are input to a subfield image generating circuit 231.

The subfield image generating circuit 231 calculates the brightness level of each pixel of each of the subfield images corresponding to the separated R, G, and B signals. Subsequently, the calculated brightness level is multiplied by n (n is the number of times at which a subfield image of the same color is displayed within one frame period). In this embodiment, the same color is displayed twice during one frame period, so that n=2. Furthermore, the brightness level multiplied by n is separated into i (i is an integer equal to or larger than 0) maximum brightness levels Lmax (the maximum brightness levels at which the display device can display images), j (j is 0 or 1) intermediate brightness levels Lmid, and k (k is an integer equal to or larger than 0) black levels 0. In this case, i, j, and k meet the relationship $i+j+k=n$ for the pixels of each subfield. If each pixel of each subfield has a brightness level L, Lmax and Lmid meet the relationship $n \times L = i \times Lmax + j \times Lmid$.

Figure 18A:
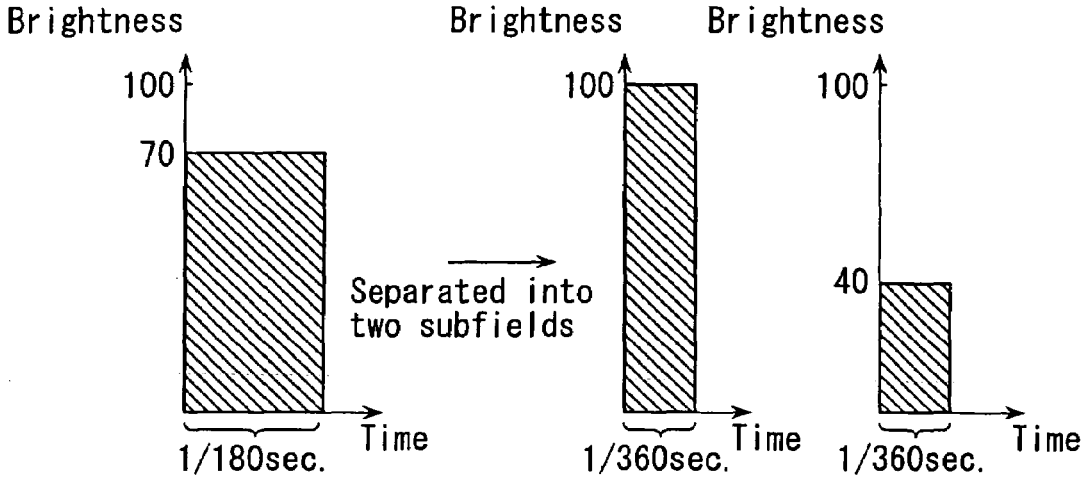
FIGS. 18A and 18B are diagrams showing an example of a method of dividing a brightness level according to the seventh embodiment of the present invention.
Figure 18B:
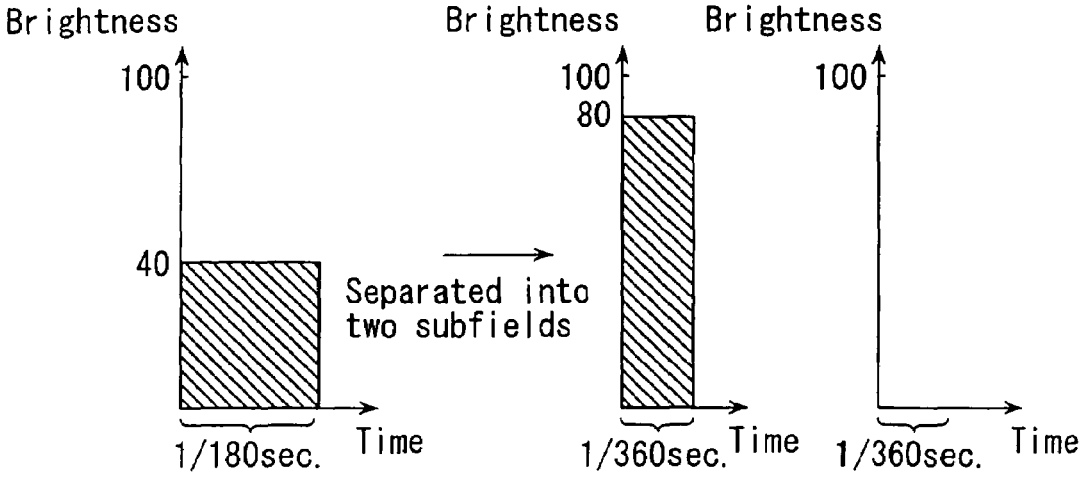

FIGS. 18A and 18B show that the brightness of a certain pixel in a certain subfield image obtained as a result of separation into three-primary-color images is further separated into two subfields. In the figure, the axis of abscissas indicates time, while the axis of ordinates indicates brightness.

If an input image for one frame is separated into three-primary-color images, then each of the images obtained is displayed for 1/180 sec. (This amounts to one third of one frame period). Then, after each image has been further separated into two subfields, each subfield image is displayed for 1/360 sec. (This amounts to one-sixth of one frame period). Provided that the maximum brightness level is 100, if a certain pixel in a subfield image has a brightness level of 70 (see FIG. 18A), the brightness level of 70 is doubled and the resulting brightness level of 140 is then separated into the maximum brightness level of 100 and an intermediate brightness level of 40. Further, if a certain pixel has a brightness level of 40 (see FIG. 18B), this brightness level is doubled and the resulting brightness level of 80 is then separated into an intermediate brightness level of 80 and a black brightness level of 0.

The above described operation separates each three-primary-color subfield image into two subfield images. The average brightness level of each of the separated subfield images is calculated. Then, subfields Rh, Gh, and Bh having higher average brightness levels and subfields Rl, Gl, and Bl having lower average brightness levels are determined. The six subfield images determined by this process are displayed in the order of average brightness level.

Figure 19A:
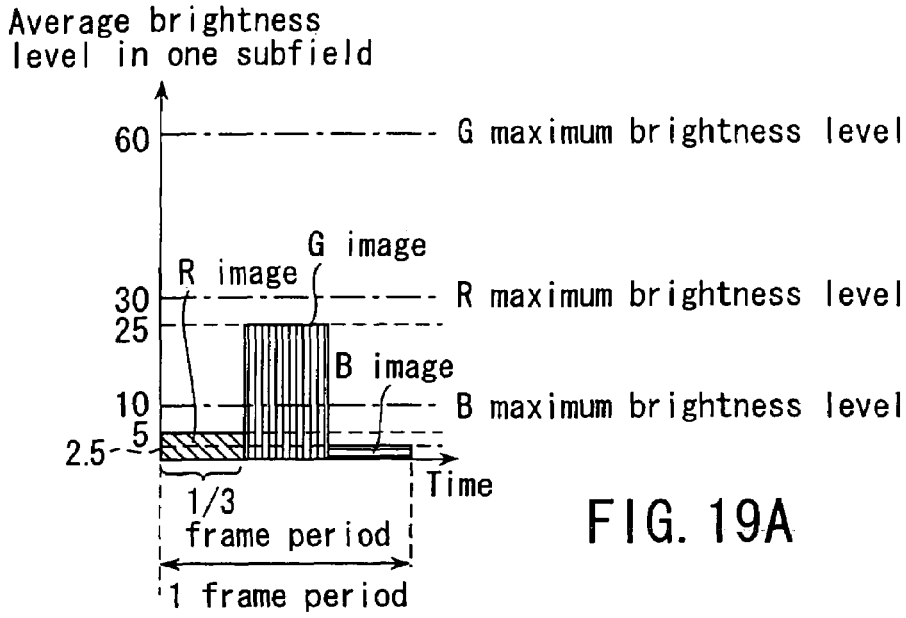
FIGS. 19A to 19C are diagrams showing an example of a manner of arranging subfield images according to the seventh embodiment of the present invention.
Figure 19B:
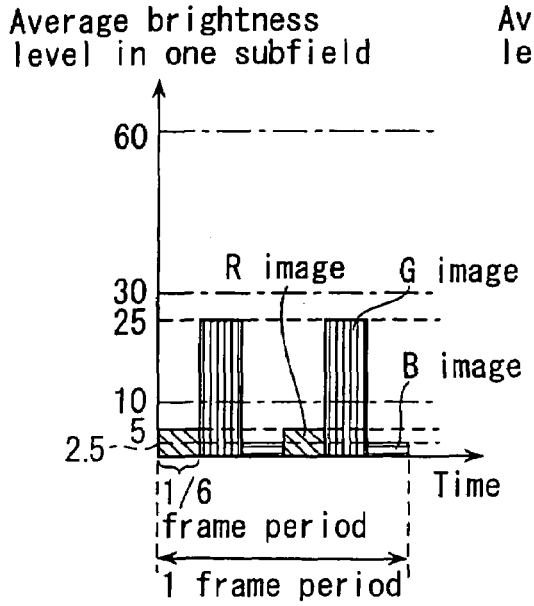
Figure 19C:
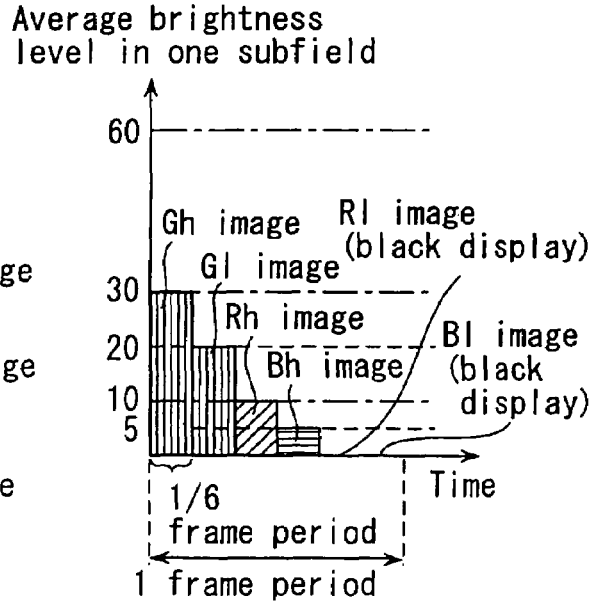

For example, a motion picture is assumed in which a box image having an R brightness level of 10, a G brightness level of 50, and a B brightness level of 5 is scrolled in a transverse direction on the black background. If images are sequentially displayed at a sixfold speed (subfield frequency: 360 Hz) in the order of decreasing average brightness level, they are displayed as shown in FIGS. 19A to 19C. In FIGS. 19A to 19C, the axis of ordinates indicates the average brightness level of the displayed image, while the axis of abscissas indicates time. The box image is assumed to be displayed in an area covering 50% of the entire screen. The ratio of R:G:B in terms of the maximum brightness level is 30:60:10 so that white is obtained when all these colors are displayed at the maximum brightness level. That is, the maximum brightness levels of R, G, and B are 30, 60, and 10.

FIG. 19A shows that an image for one frame period is displayed at a triple speed (subfield frequency: 180 Hz). FIG. 19B shows that subfields of the same color are set to have an equal brightness and that a display operation is performed at a sixfold speed in the order of R, G, B, R, G, and B. FIG. 19C shows that a display operation is performed at a sixfold speed in the order of decreasing average brightness level based on this embodiment.

The input image for each pixel is decomposed on the basis of the above described process. That is, the pixels inside the box image are decomposed so that an R subfield is decomposed into brightness levels of 20 and 0, a G subfield is decomposed into brightness levels of 60 and 40, and a B subfield is decomposed into brightness levels of 10 and 0. The average brightness level of each of the subfields obtained as described above is half of the brightness level inside the box because the box image is displayed so as to cover an area amounting to 50% of the black background. That is, for the group of subfields having higher average brightness levels, the subfields Rh, Gh, and Bh have average brightness levels of 10, 30, and 5, respectively. For the group of subfields having lower average brightness levels, the subfields Rl, Gl, and Bl have average brightness levels of 0, 20, and 0, respectively. Accordingly, if the subfield images are sequentially displayed in the order of decreasing average brightness level, they are displayed in the order of Gh, Gl, Rh, Bh, Rl, and Bl as shown in FIG. 19C. If a plurality of subfields are determined to have the same average brightness level, they may be displayed in a predetermined order.

The above described subfield images are input to the liquid crystal display panel driving circuit 216 as field sequential image signals together with a light source control signal indicative of the order in which three-primary-color images are displayed. The liquid crystal display panel driving circuit 216 sequentially displays the subfield images on the monochromic liquid crystal display panel 211. Synchronously with this display, the liquid crystal display panel driving circuit 216 lights the three-primary-color light sources 215*a* to 215*c* on the basis of the light source control signal. In this manner, color images are presented to the observer.

If an input image is divided into subfield images as described above, a light emission period can be concentrated on the former half of one frame period as shown in FIG. 19C. In contrast, if the subfield images are displayed in the order of increasing average brightness level, the light emission period can be concentrated on the latter half of one frame period. That is, the light emission period within, one frame period is substantially reduced. This reduces the amount of deviation between subfield images on the retina due to the hold effect. The emission intensity of the deviating area is also reduced. Therefore, color breakup resulting from the hold effect is suppressed to present high-quality motion pictures to the observer.

EIGHT EMBODIMENT

Now, an eighth embodiment of the present invention will be described.

The configuration of a liquid crystal display device according to this embodiment is basically similar to that shown in FIG. 17. In this embodiment, subfields of the same color are not temporally adjacent to each other.

In the following description, as in the seventh embodiment, it is assumed that an input image signal has a frame frequency of 60 Hz and that the subfield frequency is six times as high as the frame frequency of the input image signal (360 Hz). The input image signal is divided into a group of subfields having higher average brightness levels and a group of subfields having lower average brightness levels, in the same manner as that used in the seventh embodiment.

In this embodiment, the subfield images are displayed in the order in which the group of subfields having higher average brightness levels precede the group of subfields having lower average brightness levels or in the reverse order.

In each group of subfields, an R, G, B subfields may be displayed in a predetermined order. Moreover, in the other method, if the subfield images are displayed in the order in which the group of subfields having higher average brightness levels precede the group of subfields having lower average brightness levels, then the average brightness levels of the subfields are compared with one another within the group of subfields having lower average brightness levels (Rl, Gl, and Bl). Then, the subfields within the group are sequentially displayed in the order of decreasing average brightness level. In contrast, if the subfield images are displayed in the order in which the group of subfields having lower average brightness levels precede the group of subfields having higher average brightness levels, then the average brightness levels of the subfields are compared with one another within the group of subfields having lower average brightness levels (Rl, Gl, and Bl). Then, the subfields within the group are sequentially displayed in the order of increasing average brightness level.

For example, it is assumed that the subfield images are displayed in the order in which the group of subfields having higher average brightness levels precede the group of subfields having lower average brightness levels and that the subfields Rl, Gl, and Bl have average brightness levels of 5, 20, and 0, respectively. Then, in each group of subfields, the subfields are displayed in the order of G, R, and B. For one frame, the subfields are displayed in the order of Gh, Rh, Bh, Gl, Rl, and Bl.

The above described subfield images are input to the liquid crystal display panel driving circuit 216 as field sequential image signals together with a light source control signal indicative of the order in which three-primary-color image signals are displayed. The liquid crystal display panel driving circuit 216 sequentially displays the subfield images on the monochromic liquid crystal display panel 211. Synchronously with this display, the liquid crystal display panel driving circuit 216 lights the three-primary-color light sources 215*a* to 215*c* on the basis of the light source control signal. In this manner, a color image is presented to the observer.

If an input image is divided into subfield images as described above, a light emission period can be concentrated on the former half of one frame period.

Figure 20A:
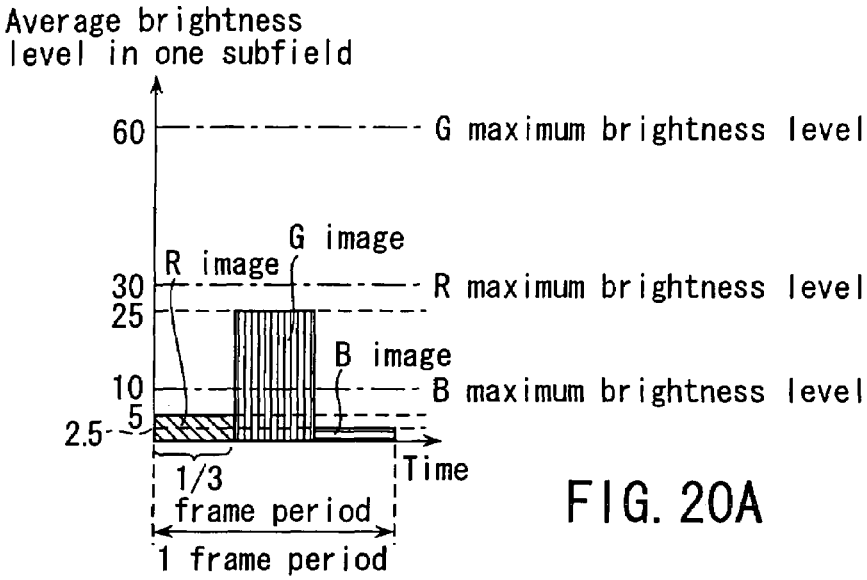
FIGS. 20A to 20C are diagrams showing an example of a manner of arranging subfield images according to an eighth embodiment of the present invention.
Figure 20B:
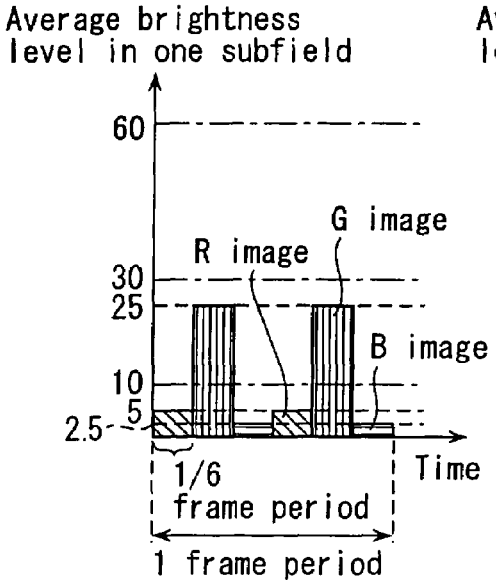
Figure 20C:
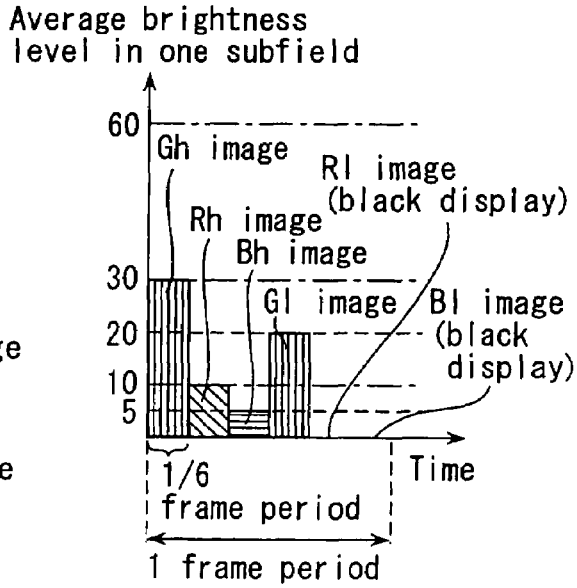

FIGS. 20A to 20C show that a box image having an R brightness level of 10, a G brightness level of 50, and a B brightness level of 5 is displayed in an area amounting to 50% of the entire screen, as in the seventh embodiment.

FIG. 20A shows that an image for one frame period is displayed at a triple speed. FIG. 20B shows that subfields of the same color are set to have an equal brightness and that a display operation is performed at a sixfold speed in the order of R, G, B, R, G, and B. FIG. 20C shows that a display operation is performed at a sixfold speed in the order of decreasing average brightness level according to the method of this embodiment. The subfields are separated into a group of subfields having higher average brightness levels (Rh=10, Gh=30, and Bh=5) and a group of subfields having lower average brightness levels (Rl=0, Gl=20, and Bl=0), as in the seventh embodiment.

If the subfields of the group of subfields having lower average brightness levels are to be arranged in the order of decreasing brightness, then in the above example, Rl=Bl. If subfields have the same average brightness level, a display operation may be performed in a predetermined order, for example, in the order of Gl, Rl, and Bl. Further, if in a group which determines the display order of subfields in a group, all subfields have the same average brightness level, then the display order is determined as follows: if the subfields are displayed starting with the group of subfields having higher average brightness levels, then the preceding group of subfields (the group of subfields having lower average brightness level) is processed as described above, and the display order within the group of subfields is determined. If the subfields are displayed starting with the group of subfields having lower average brightness levels, then the next group of subfields (the group of subfields having higher average brightness level) is processed as described above, and the display order within the group of subfields is determined. If Rl=Gl=Bl, then the average brightness levels of the subfields Rh, Gh, and Bh are compared with one another to determine the display order within the group of subfields. The above process determines the display order to be Gh, Rh, Bh, Gl, Rl, and Bl, and these subfields are displayed so as to be temporally divided, as shown in FIG. 20C.

The above described method enables the light emission period to be concentrated on the former or latter half of one frame period. Thus, the light emission period within one frame period is substantially reduced. This reduces the amount of deviation between subfield images on the retina due to the hold effect. The emission intensity of the deviating area is also reduced. Further, subfield images of the same color are not arranged temporally adjacent to each other. This suppresses color breakup caused by an increase in period of time when a certain color is displayed successively in one frame period. Therefore, color breakup resulting from the hold effect is suppressed, thereby presenting high-quality images to the observer.

NINTH EMBODIMENT

Now, a ninth embodiment of the present invention will be described.

Figure 21:
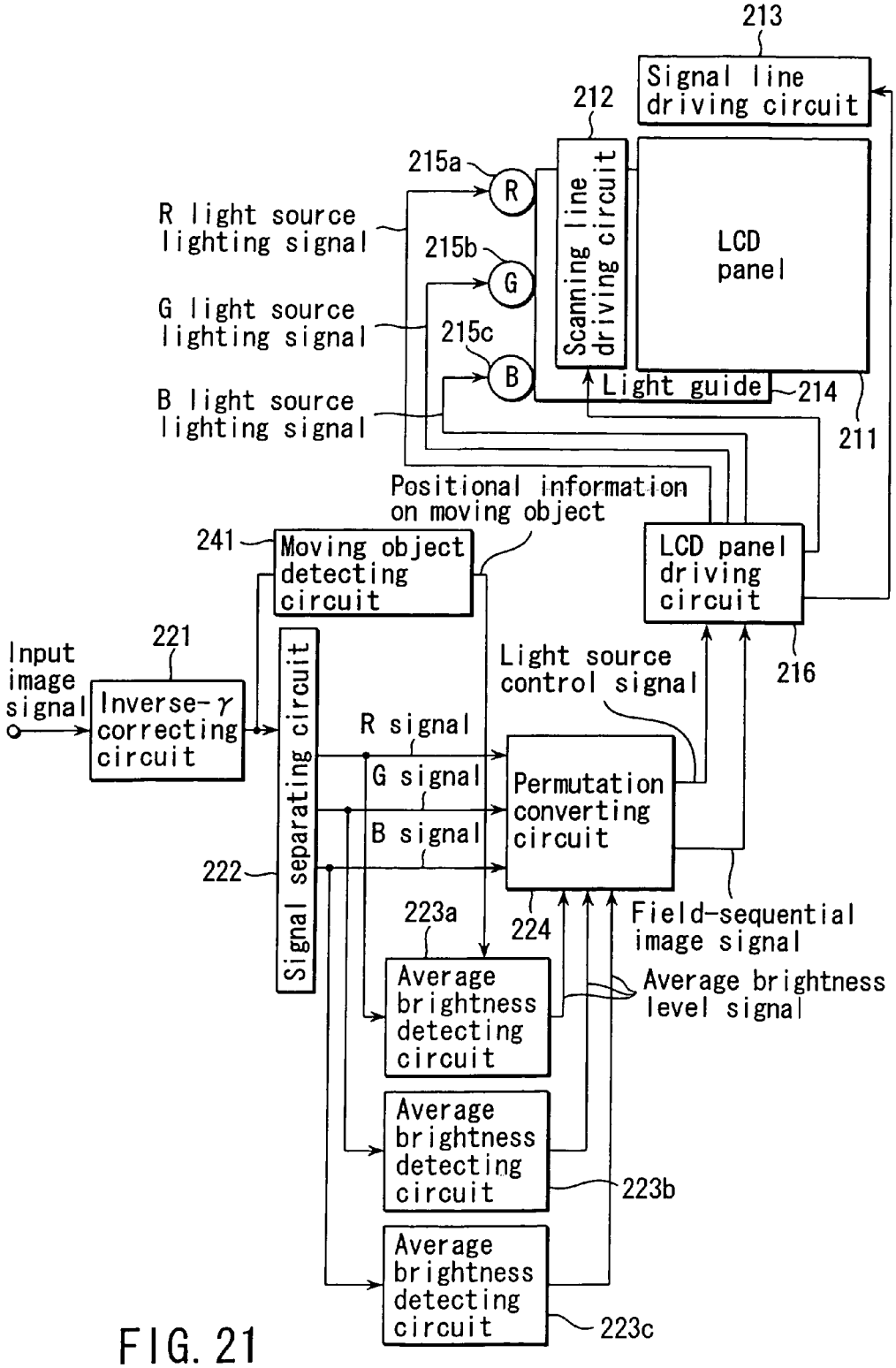
FIG. 21 is a block diagram schematically showing an example of the configuration of a liquid crystal display device according to a ninth embodiment of the present invention.

FIG. 21 is a block diagram schematically showing an example of the configuration of a liquid crystal display device according to this embodiment. The configuration of the liquid crystal display device of this embodiment is basically similar to that shown in FIG. 15. However, this embodiment is provided with a moving object detecting circuit that detects motion of an input image. The configuration and operation of this embodiment will be described below.

The operation of this embodiment is basically similar to that of the sixth embodiment or others. However, in this embodiment, when the display order of separated subfield images is to be determined, the average brightness level of a moving object area detected by the moving object detecting circuit 241 is used.

An input image signal is subjected to inverse-γ corrections by the inverse-γ correcting circuit 221 and is then input to the signal separating circuit 222 and moving object detecting circuit 241. The moving object detecting circuit 241 detects a moving object area in one frame of the input image signal. Several methods may be used to detect a moving object. In this embodiment, an edge is detected in two temporally adjacent frame images. Then, on the basis of the motion vector of the edge, a moving object area is detected. If a plurality of moving objects are detected, the main moving object area is determined on the basis of the sizes or motion vectors of the detected moving objects or the plurality of moving object areas are determined to be a single moving object area as a whole.

Positional information on the moving object output by the moving object detecting circuit 241 is input to the average brightness detecting circuits 223*a*, 223*b*, and 223*c* together with an R, G, and B signals separated by the signal separating circuit 222. The average brightness detecting circuit detects the average brightness level of each of the R, G, and B signals in the moving object area. The average brightness level signals for the moving object area are input to the permutation converting circuit 224 together with the separated R, G, and B signals.

The permutation converting circuit 224 has a frame buffer. This frame buffer is used to arrange the R, G, and B signals in an ascending or descending order based on the order of the intensity of the average brightness level. The R, G, and B signals are output as field sequential image signals by the permutation converting circuit 224 at a frequency three times as high as the frame frequency of the input image signal. The liquid crystal display panel driving circuit 216 receives the field sequential image signals and a light source control signal indicative of the permutation of the R, G, and B signals.

By dividing an input image into subfield images as described above, color breakup can be effectively suppressed in a moving object area where this phenomenon is likely to occur because of the hold effect.

TENTH EMBODIMENT

Now, a tenth embodiment of the present invention will be described.

Figure 22:
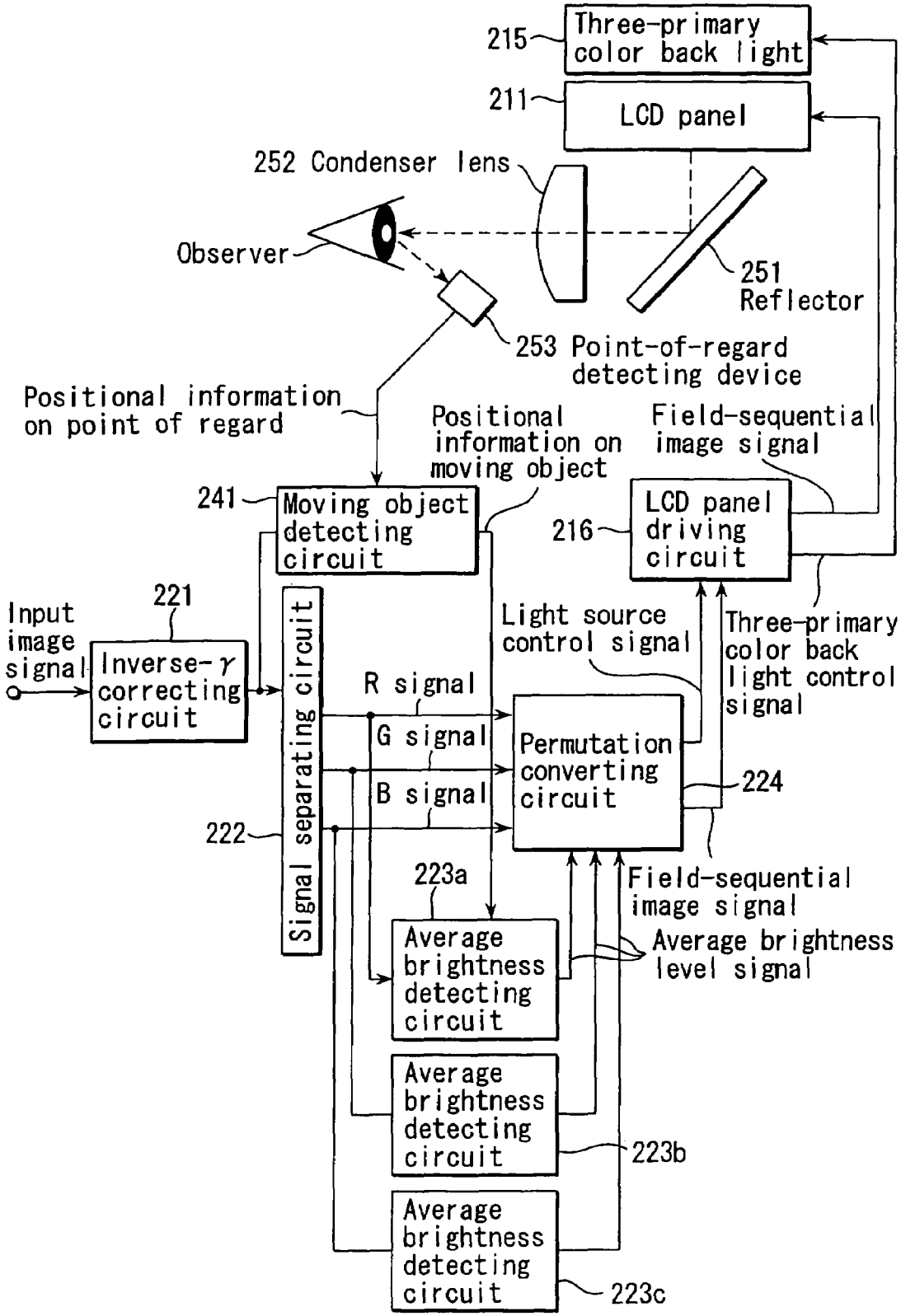
FIG. 22 is a block diagram schematically showing an example of the configuration of a liquid crystal display device according to a tenth embodiment of the present invention.
Figure 23A:
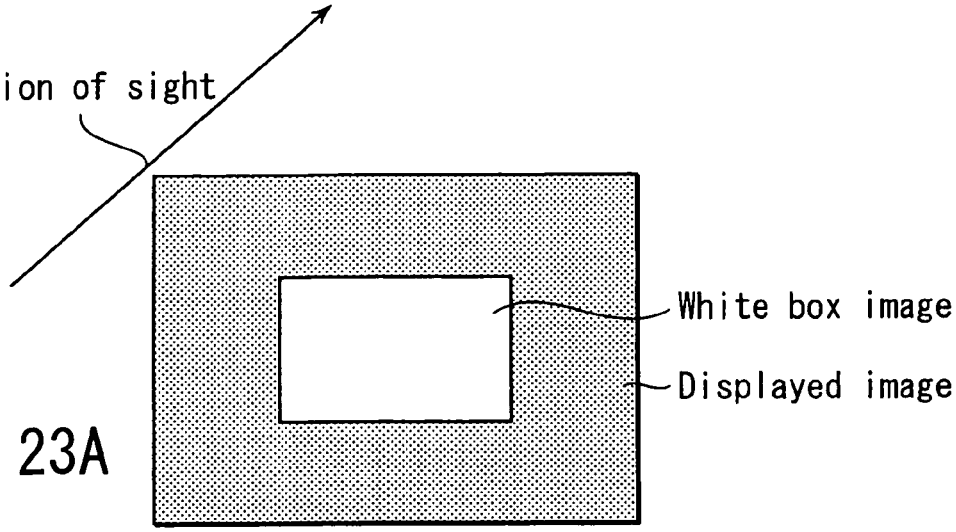
FIGS. 23A and 23B are diagrams showing color breakup that may occur in a field-sequentially additive color mixing system.
Figure 23B:
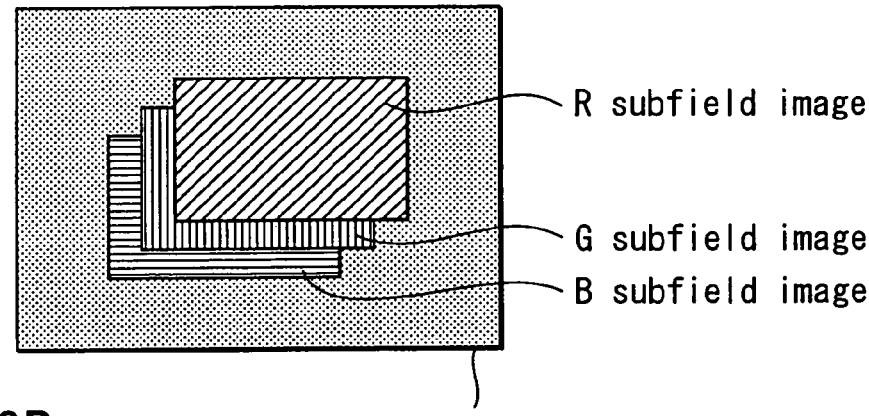
Figure 24:
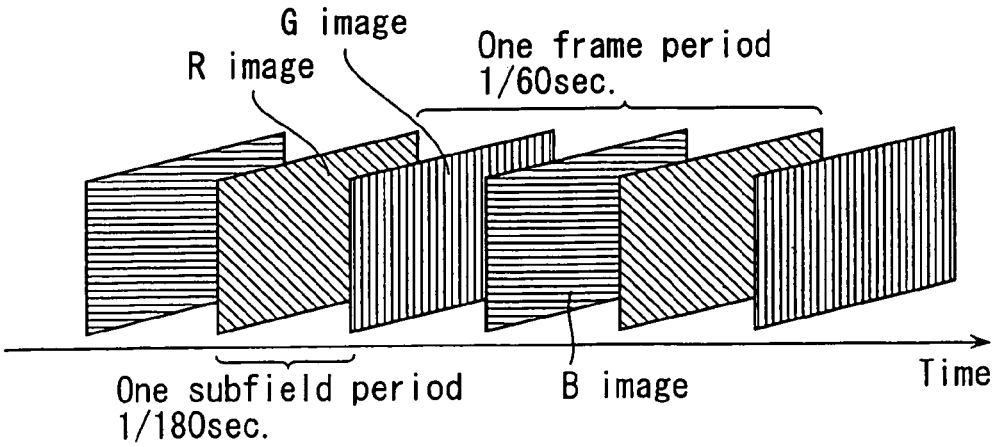
FIG. 24 is a diagram showing a flow in the direction of a time base in the field-sequentially additive color mixing system.

FIG. 22 is a block diagram schematically showing an example of the configuration of a liquid crystal display device according to this embodiment. The configuration of the liquid crystal display device according to this embodiment is basically similar to that shown in FIG. 21. However, this embodiment is a head mount display provided with a point-of-regard detecting device. The configuration and operation of this embodiment will be described below in detail.

The operation of this embodiment is basically similar to that of the ninth embodiment. However, in this embodiment, an image on the liquid crystal display panel 211 is viewed by the observer via a reflector element 251 and a condenser lens 252. Then, the display order of subfield images is determined using the average brightness level of a moving object area detected by the point-of-regard detecting device 253 and moving object detecting circuit 241.

An input image signal is subjected to inverse-γ corrections by the inverse-γ correcting circuit 221 and is then input to the signal separating circuit 222 and moving object detecting circuit 241. The moving object detecting circuit 241 detects a moving object area in the input image signal for one frame. Then, that part of the detected moving object area which includes the observer's point of regard position detected by the point-of-regard detecting device 253 is determined to be the main moving object area. If the point of regard area is not a moving object, a process similar to that used in the ninth embodiment is executed to determine the main moving object area. Several methods may be used to detect the point of regard. In this embodiment, the observer's point of regard is detected on the basis of an image reflected by the cornea and the central position of the pupil when the observer's eyes are irradiated with near infrared light.

Positional information on the moving object (positional information on the main moving object) output by the moving object detecting circuit 241 is input to the average brightness detecting circuits 223*a*, 223*b*, and 223*c* together with an R, G, and B signals separated by the signal separating circuit 222. The average brightness detecting circuit detects the average brightness level of each of the R, G, and B signals in the main moving object area. The average brightness level signals for the moving object area are input to the permutation converting circuit 224 together with the separated R, G, and B signals.

The permutation converting circuit 224 has a frame buffer. This frame buffer is used to arrange the R, G, and B signals in an ascending or descending order based on the order of the magnitude of the average brightness level. The R, G, and B signals are output as field sequential image signals by the permutation converting circuit 224 at a frequency three times as high as the frame frequency of the input image signal. The liquid crystal display panel driving circuit 216 receives the field sequential image signals and a light source control signal indicative of the permutation of the R, G, and B signals.

Also in this embodiment, color breakup can be effectively suppressed in a moving object area where this phenomenon is likely to occur because of the hold effect, as in the ninth embodiment.

As described above, according to the sixth to tenth embodiments, if one frame is divided into a plurality of subfields to display color images on the basis of the field-sequentially additive color mixing system, subfield images are rearranged in the order of decreasing or increasing brightness. This hinders color breakup from occurring when motion pictures are displayed, thereby providing high-quality images.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image display method comprising:

dividing an original image for one frame period to be displayed on an entire screen into a plurality of subfield images;

arranging the subfield images in a direction of a time axis in an order of brightness of the subfield images; and displaying the arranged subfield images on the entire screen in the order of the brightness, wherein the original image is a color image formed of three-primary colors comprising a first primary color, a second primary color and a third primary color, and wherein the dividing includes dividing the color image into a first image formed of the first primary color, a second image formed of the second primary color and a third image formed of the third primary color to obtain the subfield images.

2. An image display method comprising:

dividing an original image for one frame period to be displayed on an entire screen into a plurality of subfield images;

arranging the subfield images in a direction of a time axis in an order of brightness of the subfield images; and displaying the arranged subfield images on the entire screen in the order of the brightness, wherein the original image is a color image formed of three-primary colors comprising a first primary color, a second primary color and a third primary color, and wherein the dividing includes dividing the color image into a first image formed of the first primary color, a second image formed of the second primary color and a third image formed of the third primary color and dividing each of the first, second and third images into a plurality of images to obtain the subfield images.

3. An image display method comprising:

dividing an original image for one frame period to be displayed on an entire screen into a plurality of subfield images;

arranging the subfield images in a direction of a time axis in an order of brightness of the subfield images; and displaying the arranged subfield images on the entire screen in the order of the brightness, wherein the original image is a single primary color image separated from a color image formed of three-primary colors, and wherein the dividing includes dividing the single primary color image into a plurality of images to obtain the subfield images.

4. An image display method comprising:

dividing an original image for one frame period to be displayed on an entire screen into a plurality of subfield images;

arranging the subfield images in a direction of a time axis in an order of brightness of the subfield images; and displaying the arranged subfield images on the entire screen in the order of the brightness, wherein the dividing includes distributing brightness of the original image to a plurality of subfields, and wherein the distributing includes providing brightness Lmax to m (m denotes an integer equal to or larger than 0) subfields and providing brightness $n \times L - m \times Lmax$ ($n \times L - m \times Lmax < Lmax$) to one subfield, where L denotes the brightness of the original image, n (n is an integer equal to or larger than 2) denotes the number of subfields, and Lmax denotes predetermined maximum brightness.

5. An image display method comprising:

dividing an original image for one frame period to be displayed on an entire screen into a plurality of subfield images;

arranging the subfield images in a direction of a time axis in an order of brightness of the subfield images; and displaying the arranged subfield images on the entire screen in the order of the brightness, wherein the dividing includes distributing brightness of the original image to a plurality of subfields, and wherein the distributing includes obtaining differential brightness between brightness to be set for a certain pixel and predetermined maximum brightness and providing the differential brightness to a pixel adjacent to the certain pixel.

6. An image display method comprising:

dividing an original image for one frame period to be displayed on an entire screen into a plurality of subfield images;

arranging the subfield images in a direction of a time axis in an order of brightness of the subfield images;

displaying the arranged subfield images on the entire screen in the order of the brightness; and detecting a motion area in the original image and determining average brightness of the detected motion area, wherein the subfield images are arranged in the order of the brightness on the basis of the average brightness of the motion area.

* * * * *

UNITED STATES PATENT AND TRADEMARK OFFICE

CERTIFICATE OF CORRECTION

PATENT NO. : 7,295,173 B2
APPLICATION NO. : 11/059385
DATED : November 13, 2007
INVENTOR(S) : Goh Itoh et al.

It is certified that error appears in the above-identified patent and that said Letters Patent is hereby corrected as shown below:

Please insert on the front page of this patent at (*) section, last line thereof, and before code (21), the following:

--This patent is subject to a terminal disclaimer.--

Signed and Sealed this

Tenth Day of June, 2008

JON W. DUDAS
*Director of the United States Patent and Trademark Office*